US007673422B2

(12) United States Patent
De La Marche

(10) Patent No.: US 7,673,422 B2
(45) Date of Patent: Mar. 9, 2010

(54) MODULAR BUILDINGS

(76) Inventor: Peter William De La Marche, 33 Hopwood Avenue, Hopwood, Heywood, OL10 2AX (GB)

( * ) Notice: Subject to any disclaimer, the term of this patent is extended or adjusted under 35 U.S.C. 154(b) by 705 days.

(21) Appl. No.: 11/287,476

(22) Filed: Nov. 23, 2005

(65) Prior Publication Data

US 2006/0130422 A1 Jun. 22, 2006

Related U.S. Application Data

(63) Continuation of application No. 10/363,351, filed on Aug. 1, 2003, now abandoned.

(51) Int. Cl.
*E04H 3/00* (2006.01)
*E04H 5/00* (2006.01)
*E04H 14/00* (2006.01)

(52) U.S. Cl. ..... 52/79.8; 52/79.9; 52/79.11; 52/220.2; 52/220.3; 52/220.8; 52/238.1; 52/79.12

(58) Field of Classification Search ..... 52/79.1, 52/79.2, 79.4, 79.7, 79.8, 270–271, 79.3, 52/79.11, 79.13, 79.14, 234–243, 220.1, 52/220.3, 220.5, 220.6, 220.7, 220.8
See application file for complete search history.

(56) References Cited

U.S. PATENT DOCUMENTS 2,171,338 A * 8/1939 Henderson ..... 52/220.2
2,691,291 A * 10/1954 Henderson ..... 52/79.9
2,751,635 A * 6/1956 Donnahue ..... 52/79.7
2,991,717 A 7/1961 Kollmeyer
3,282,004 A 11/1966 Brounn
3,293,632 A 12/1966 Blume
3,564,795 A * 2/1971 Henton ..... 52/79.2
3,643,389 A * 2/1972 Sheppley, Jr. ..... 52/79.1
3,660,952 A 5/1972 Wilson
3,712,007 A * 1/1973 Kump ..... 52/79.12
3,713,176 A 1/1973 Stock
3,793,428 A * 2/1974 Gordon ..... 264/250
3,798,852 A 3/1974 Nicoll, Jr.
3,849,952 A * 11/1974 Hanaoka ..... 52/79.5
3,871,146 A * 3/1975 Hamy ..... 52/79.7
3,883,999 A 5/1975 Nicoll, Jr.
3,887,952 A 6/1975 Nicoll, Jr.
3,893,271 A * 7/1975 Kotlarz ..... 52/168
3,894,354 A 7/1975 Crawley
3,955,328 A * 5/1976 Lindsay ..... 52/73
3,990,193 A * 11/1976 Ray et al. ..... 52/79.11

(Continued)

FOREIGN PATENT DOCUMENTS

DE 15 59 231 A 9/1969

(Continued)

*Primary Examiner*—Jeanette E. Chapman
(74) *Attorney, Agent, or Firm*—Woodard, Emhardt, Moriarty, McNett & Henry LLP

(57) ABSTRACT

A building module has an open-ended box structure and comprises a plurality of interconnected coaxial module segments. Each segment is moulded as an open-ended box structure from a composite material. The segments are held together by elongate tie bars that form part of a lifting frame and extend substantially along the length of the module. The lifting frame comprises end frames that are embedded in end segments of the modules and that are connected to each other by the tie bars.

29 Claims, 21 Drawing Sheets

U.S. PATENT DOCUMENTS

| | | | | | |
|---|---|---|---|---|---|
| 4,185,423 | A | * | 1/1980 | Gutierrez | 52/79.9 |
| RE30,280 | E | * | 5/1980 | Berman et al. | 290/1 R |
| 4,353,193 | A | | 10/1982 | Sanderson | |
| 4,428,994 | A | | 1/1984 | Rawlins | |
| 4,432,171 | A | * | 2/1984 | Boot | 52/79.1 |
| 4,509,301 | A | * | 4/1985 | Head | 52/79.8 |
| 4,580,776 | A | * | 4/1986 | Burkinshaw | 52/7 |
| 4,622,787 | A | * | 11/1986 | Scott | 52/58 |
| 4,706,551 | A | * | 11/1987 | Schofield | 454/66 |
| 4,866,833 | A | * | 9/1989 | Ward | 29/445 |
| 5,265,389 | A | | 11/1993 | Mazzone et al. | |
| 5,281,185 | A | | 1/1994 | Lee | |
| 5,394,897 | A | * | 3/1995 | Ritchey et al. | 135/124 |
| 5,417,023 | A | | 5/1995 | Mandish | |
| 5,487,240 | A | * | 1/1996 | Miller | 52/33 |
| 5,836,254 | A | | 11/1998 | Johansson | |
| 6,145,257 | A | * | 11/2000 | Cappuccio | 52/220.2 |
| D442,299 | S | | 5/2001 | Boone | |
| 6,244,010 | B1 | | 6/2001 | Sluiter | |
| 6,253,520 | B1 | | 7/2001 | Houk | |
| 6,308,487 | B1 | | 10/2001 | Cantley | |
| 6,925,761 | B1 | * | 8/2005 | De La Marche | 52/79.7 |

FOREIGN PATENT DOCUMENTS

| | | |
|---|---|---|
| FR | 1 601 868 A | 9/1970 |
| WO | WO 94/13900 | 6/1994 |

* cited by examiner

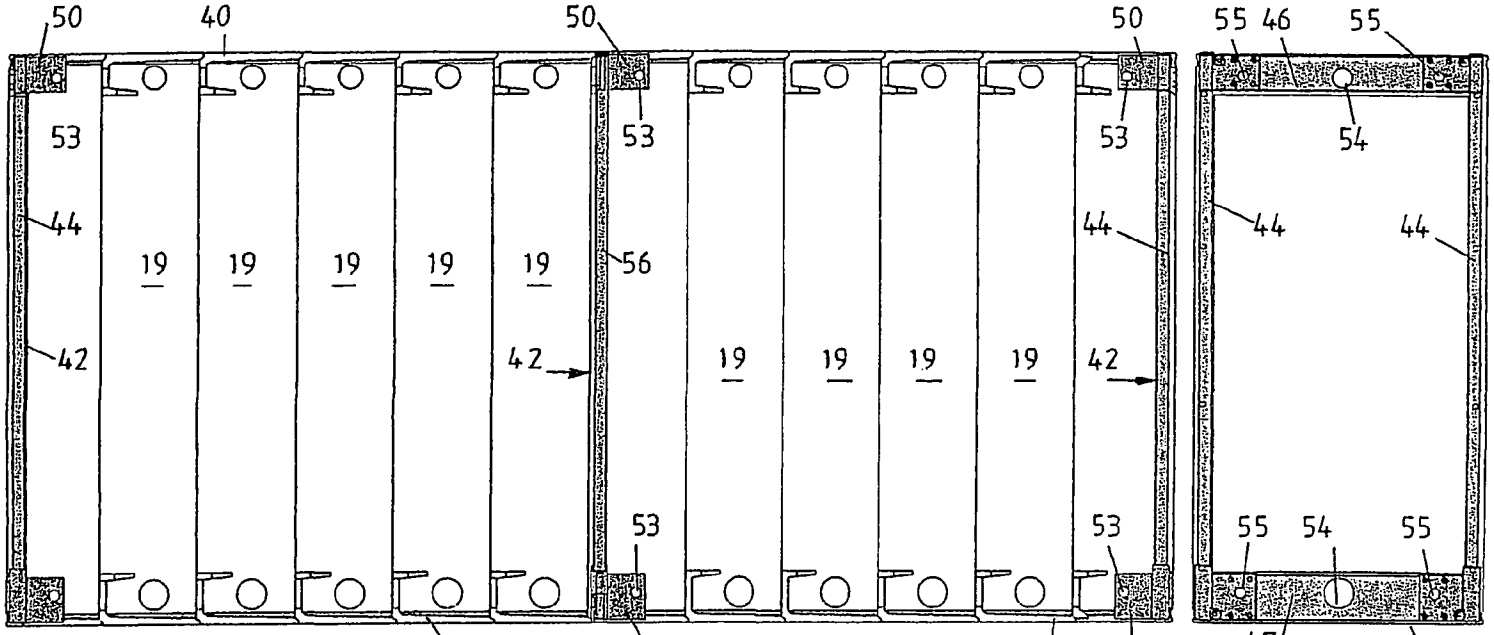
FIG. 14
FIG. 12
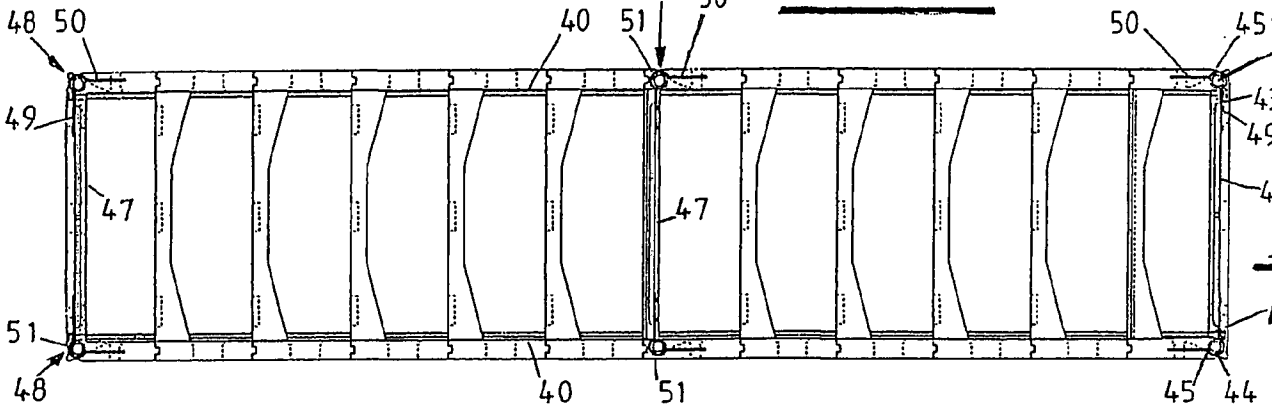
FIG. 13

66
65
48
67

68

65
66
66
65
44
44

63
59
58
44
64
44
64
51
48
58
50
45
49
60
60
61
49
61
62
62
60
70
69

MODULAR BUILDINGS

CROSS REFERENCE TO RELATED APPLICATIONS

This application is a continuation and claims priority from the U.S. patent application Ser. No. 10/363,351, filed Aug. 1, 2003 now abandoned, which is incorporated herein by reference in its entirety.

The present invention relates to modular buildings.

It is well known to provide for modular building structures in which a plurality of prefabricated, portable, modular units are assembled into a complete building construction. Such structures are typically used in circumstances where accommodation is needed in an emergency or on a temporary basis and this has to be rapidly and easily assembled to meet the demand for emergency habitable structures in times, for example, of natural or other disasters. In addition, such buildings are often required in remote locations by workers employed in the construction industry where temporary accommodation is needed during the term of the construction project.

There is a need for an all-purpose modular building system that can be exploited by both the residential and commercial construction sectors of industry. To date, portable and prefabricated building designs have not proved suitable for application in both sectors. Modular buildings have the advantages that they are easy and quick to erect, dismantle or relocate, are readily transportable, and flexible in that they are re-configurable to meet changing size or other requirements. Unfortunately existing designs of such buildings are generally of a temporary nature and are not suited to long-term or permanent applications.

Existing modular buildings suffer from several disadvantages including: racking which causes wear and tear to the structure of the building and often leads to leaks, creaks and structural damage; condensation; inadequate interior temperature control; ineffective noise insulation; and an excessive ingress of dirt and dust (particularly in environments such as construction sites).

A modular building structure that obviates or mitigates the aforesaid disadvantages is described in my PCT patent application No. WO 00/01898. The modular building structures described therein comprise a corridor walkway module to which are connected separate accommodation modules that form offices or accommodation etc. The floor or ceiling of the corridor walkway carries mains services to the accommodation modules. The structures have improved life expectancies whilst retaining the benefits of modular construction.

The object of the present invention is to provide for a modular building structure that is an improvement over the designs described in my aforementioned PCT application.

According to a first aspect of the present invention there is provided a building module having an open-ended box structure with top, bottom and opposed side walls and comprising a plurality of interconnected coaxial module segments each being moulded as an open-ended box structure from a composite material, at least one of the segments having a strengthening beam spanning the opposed side walls.

The segmented structure of the building module of the present invention provides for a very flexible arrangement in which the length of a module can be varied by selection of the appropriate number of segments. By moulding the composite material of one or more segments around a lifting frame the module is compact but easily transportable. The open-ended box structure provides for a very rigid construction without the need for expensive superstructures or foundations and with resistance to racking. Moulds may be produced of different widths.

The beam provides extra strength to counteract racking or other similar movement and provides a neat and compact formation on which a floor or ceiling structure can be mounted. It is preferably connected to one or other of the top and bottom walls.

The strengthening beam may be connected to the bottom wall and may support a floor structure or may be, additionally or alternatively, connected to the top wall and may support a ceiling structure. The beam or beams may be integrally moulded with the segment.

The beam of each segment preferably has ports to allow passage of service conduits below the module floor or above the module ceiling. Service conduits such as water or waste pipes and electrical cables can thus be disposed easily below floor or above ceiling level before passing through the floor or ceiling to feed appliances in the module.

At least one of the segments may have an integral lifting frame by which the module may be lifted for transportation or assembly into a building structure.

In a preferred embodiment at least two of the segments have a lifting frame and the frames are interconnected by a plurality of elongate support members.

The elongate support members may be connected to the segments via part of the lifting frame.

At least some of said elongate support members may be disposed above a ceiling of the module and at least some of said elongate support members may be disposed, additionally or alternatively, below a floor of the module. In each case the members preferably pass through apertures in the corner of the segment and ideally through apertures in the beams.

In a preferred embodiment the end segments of the module have integral frames and a mid-module segment also has an integral frame.

The frame may comprise a pair of spaced substantially vertical posts interconnected by upper and lower cross-members. The posts may be connected to the cross-members by means of corner plate members.

Preferably the corner plate members comprise first and second connector portions disposed substantially at a right angle to each other. Furthermore, the first and second connector portions may be joined by an intermediate arcuate portion in which part of the post is received.

The corner plate may be connected to the elongate support member.

Ideally the posts have adjustable feet for altering the height of the module relative to the ground.

An upper end of the post may be fitted with a lifting attachment by which the module may be lifted. Alternatively an upper end of the post is fitted with an inter-module connector for interconnecting vertically adjacent modules.

The exterior of the side and end walls of the module may have at least one channel in which is received a resiliently flexible material.

The composite material is preferably a water extendable polyester resin with a mineral filler.

At least one of the segments may have an upper wall in which there is disposed reinforcing mesh material.

The segments may be connected to one another by a tongue and groove formation. Although alternative joints may be used.

The module has a side wall in which there may be ports that allow passage of service conduits. Such ports allow the service conduits to pass laterally of the module to adjacent modules or elsewhere, preferably above ceiling level or below floor level. The segments are preferably of a unitary construction but may be formed of one or more connected parts.

According to a second aspect of the present invention there is provided a building structure comprising a plurality of building modules as defined above.

According to a third aspect of the present invention there is provided a building structure comprising a plurality of interconnected open-ended box structure building modules, wherein there is provided a resiliently deformable material sandwiched between adjacent walls of at least two modules.

A specific embodiment of the present invention will now be described, by way of example only, with reference to the accompanying drawings in which:

FIG. 12 is a sectioned schematic side elevation of the building module of FIGS. 3 to 5 shown fitted with the lifting frame of FIG. 11;

FIG. 13 is a sectioned plan view of the module of FIG. 12;

FIG. 14 is an end view of the module of FIG. 13;

Figures 15, 16A, 16B, 17A, 17B:
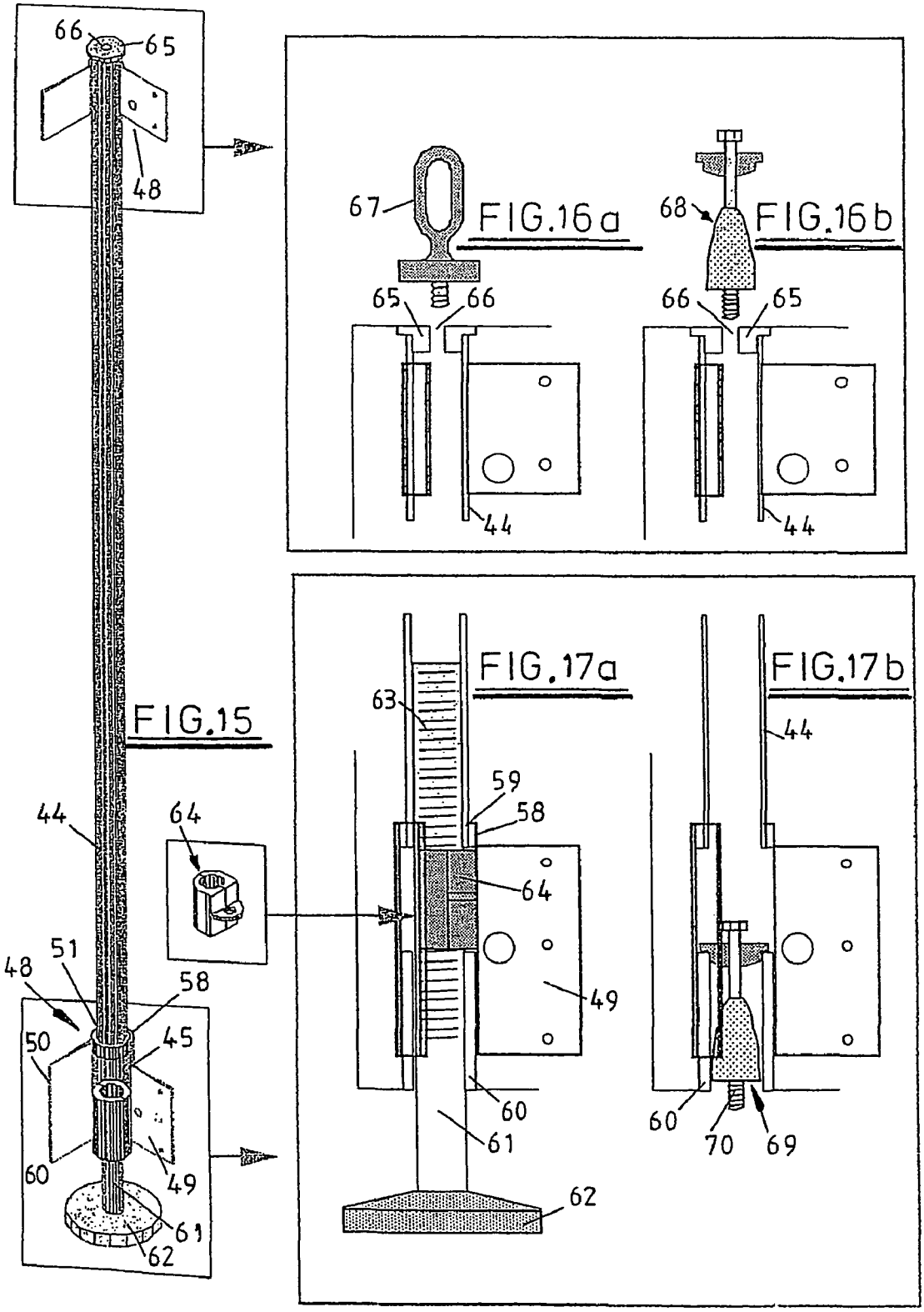
FIG. 15 is a perspective isometric view of a post of the lifting frame of FIG. 11.
Figure 18:
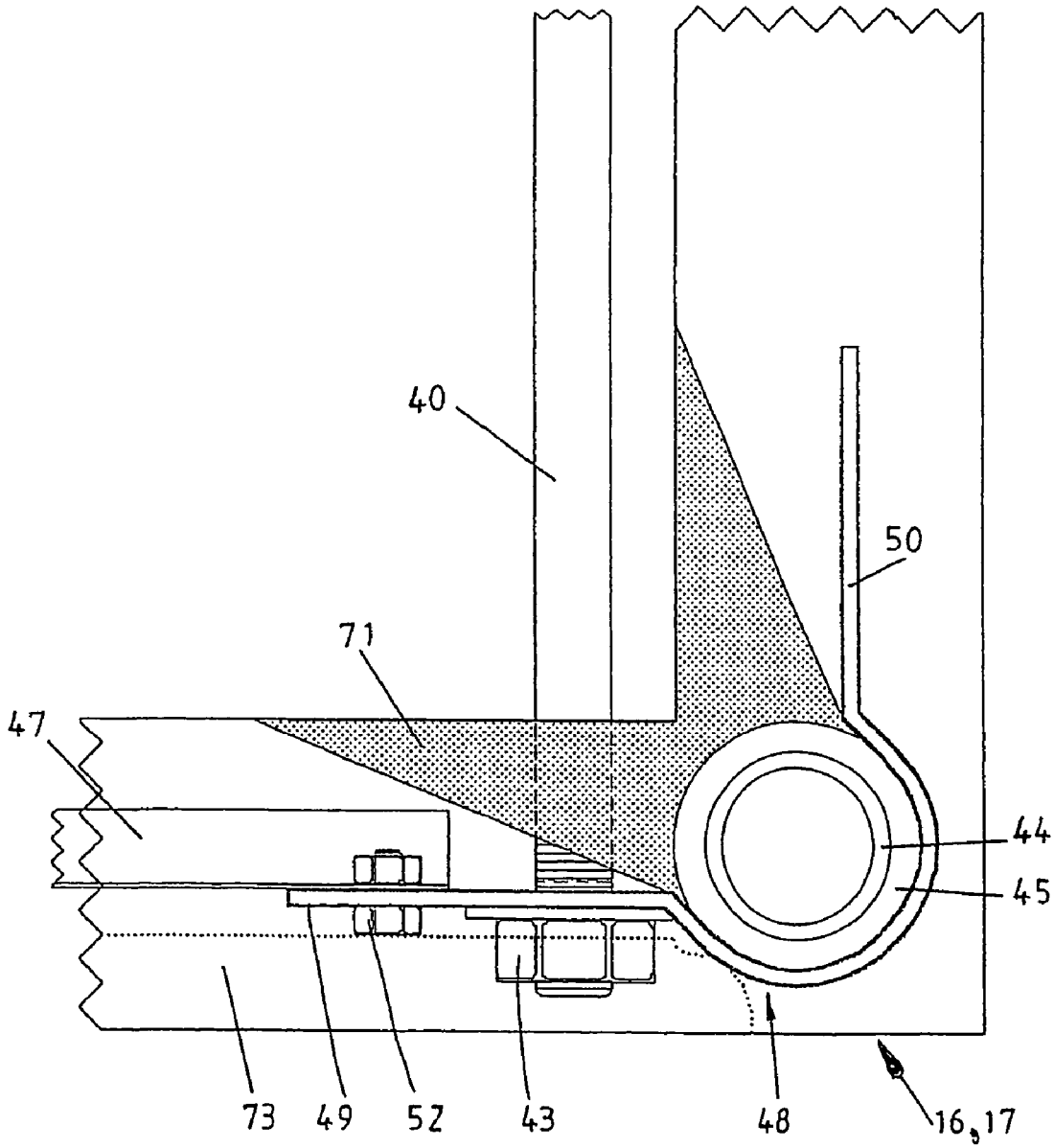
Figure 19:
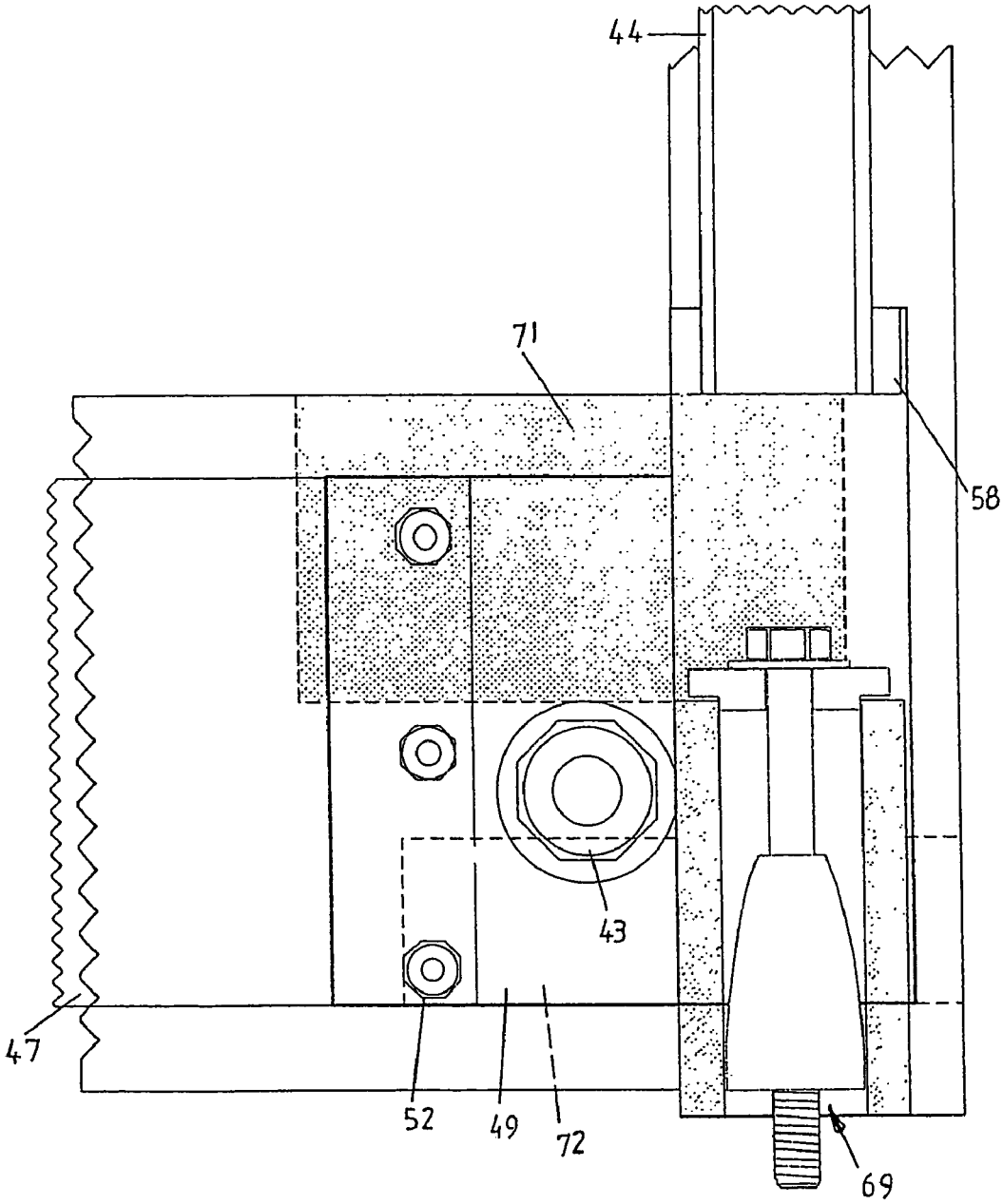
Figure 20:
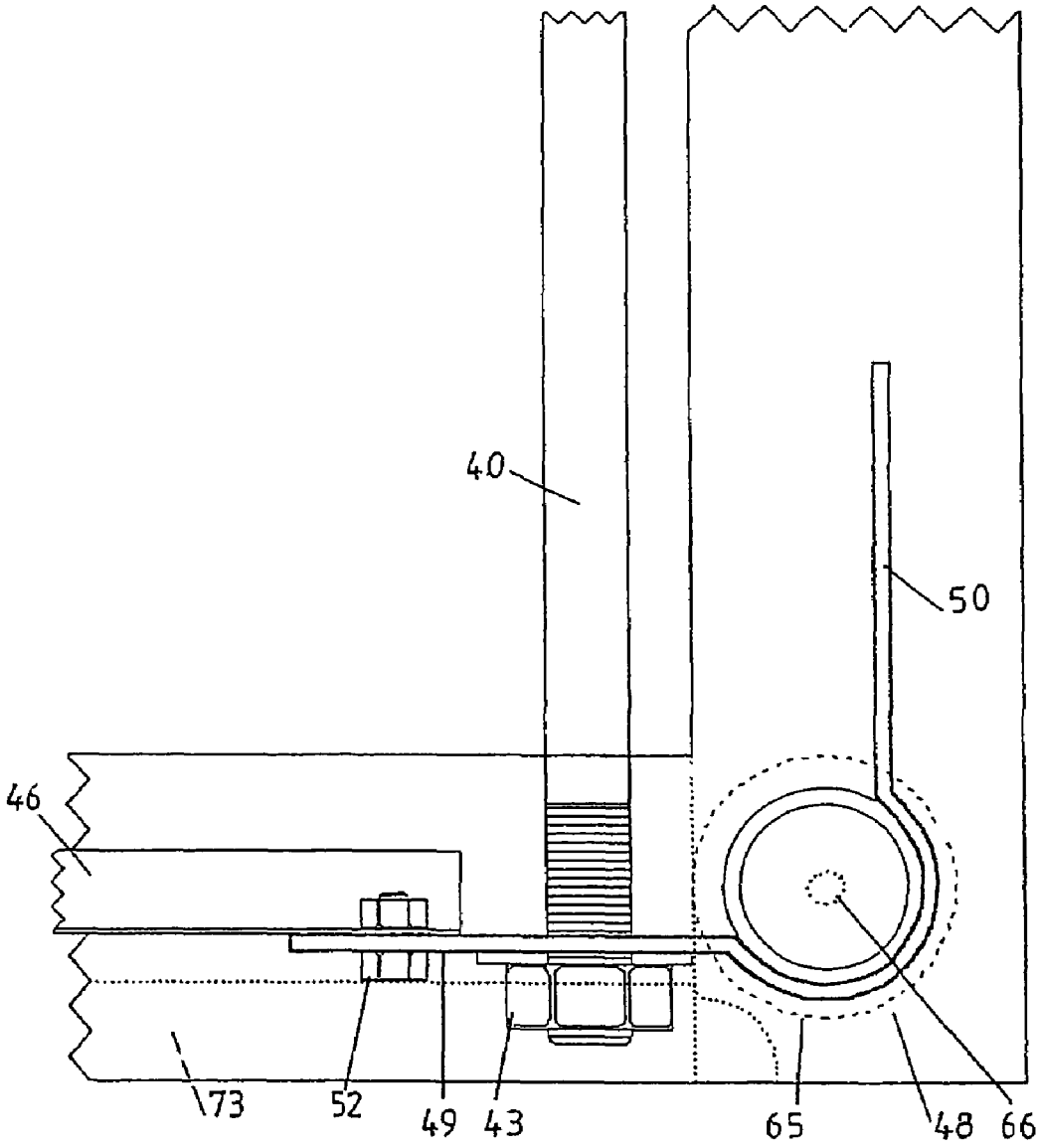
Figure 21:
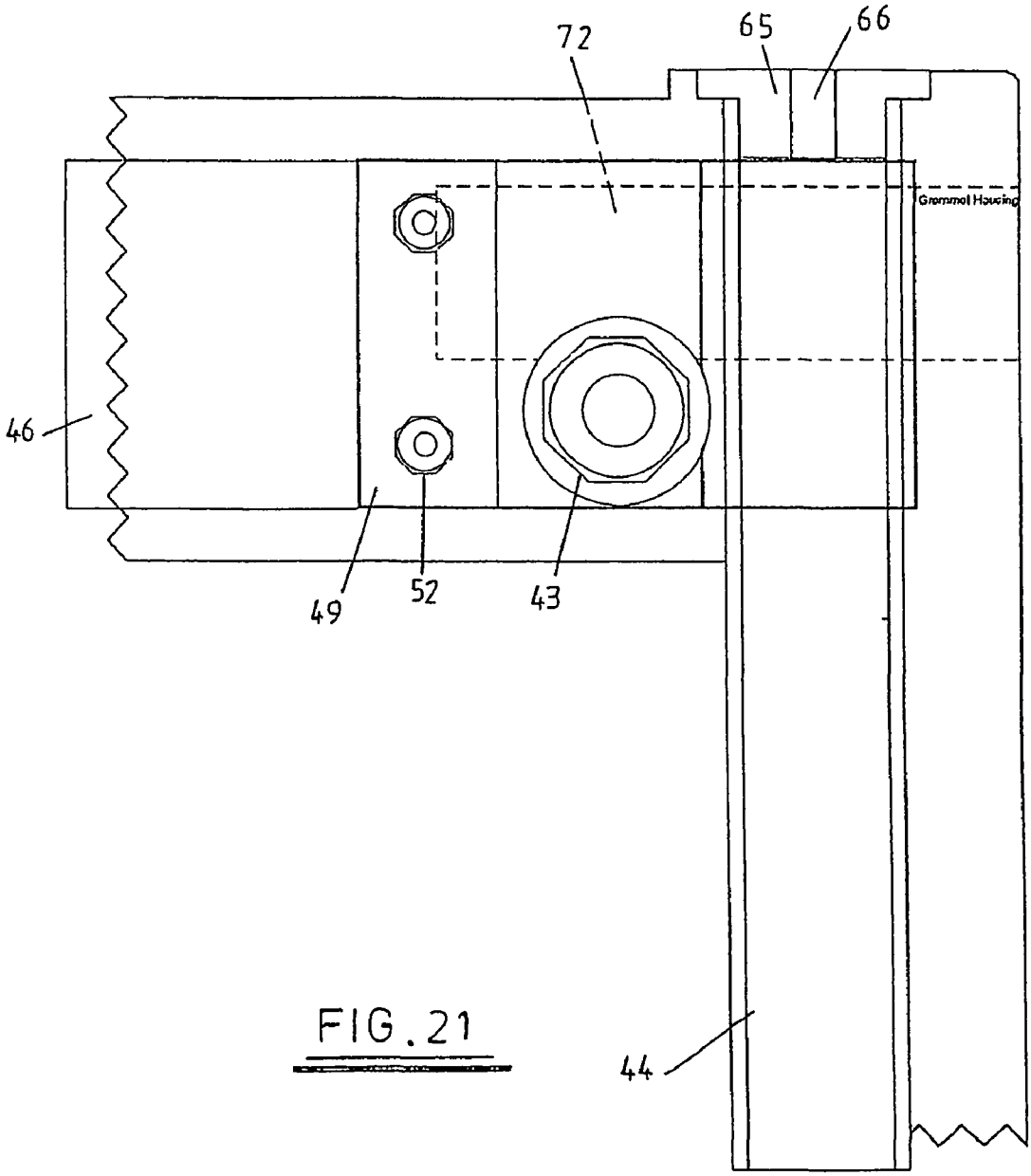
Figure 23:
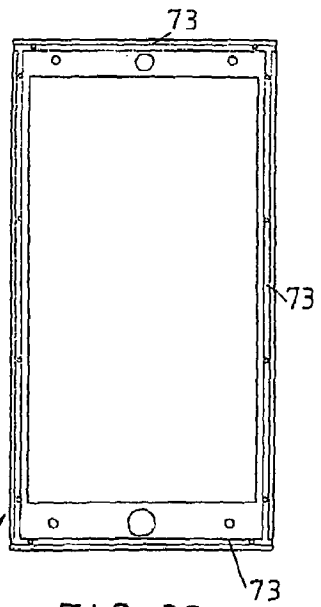
Figure 22:
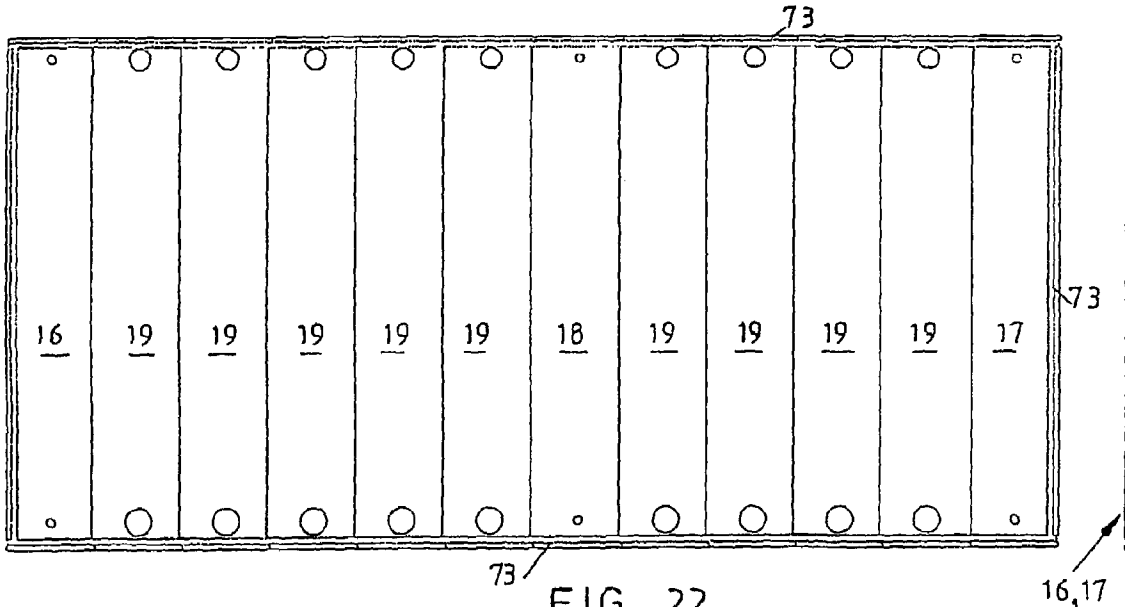
Figure 24:
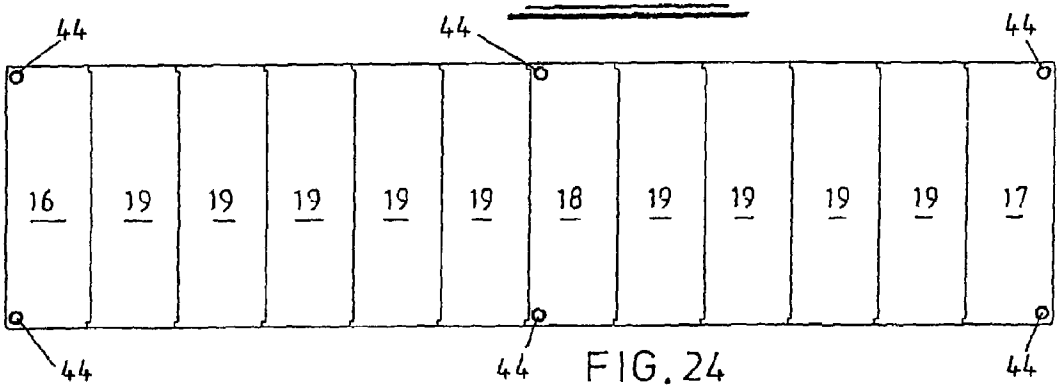
Figure 25A:
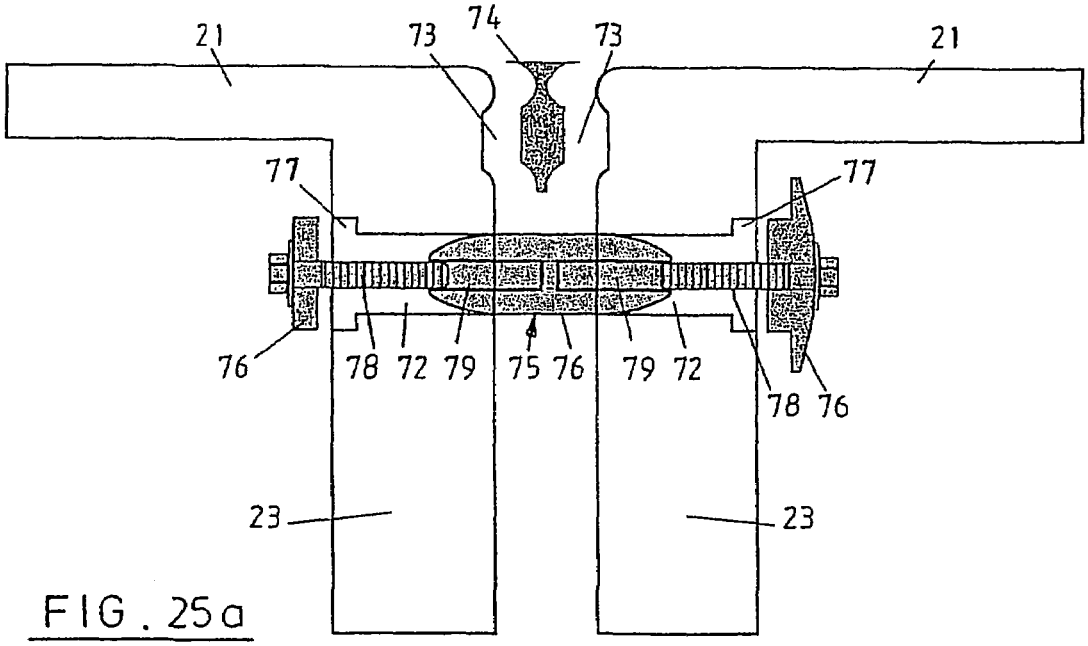
Figure 25B:
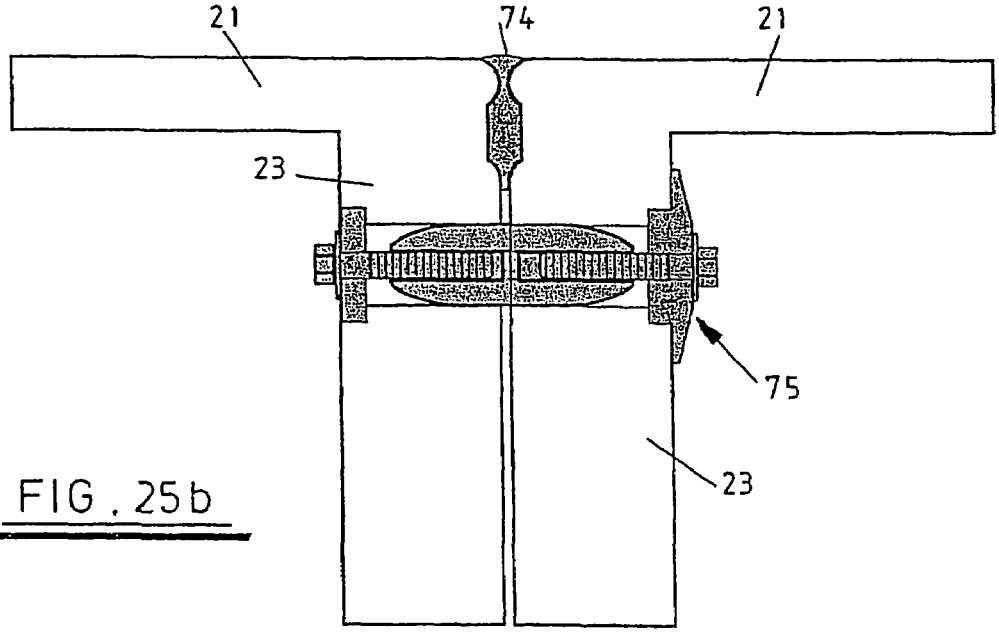
Figure 26:
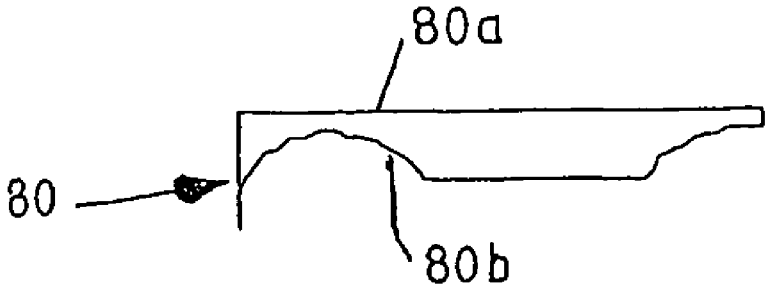
Figure 27:
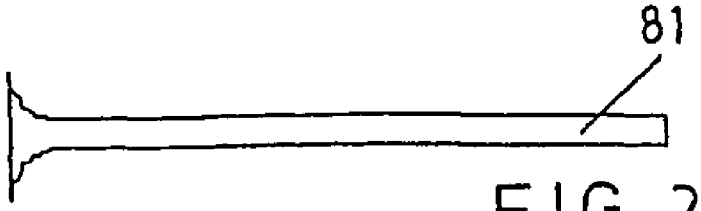
Figure 28:
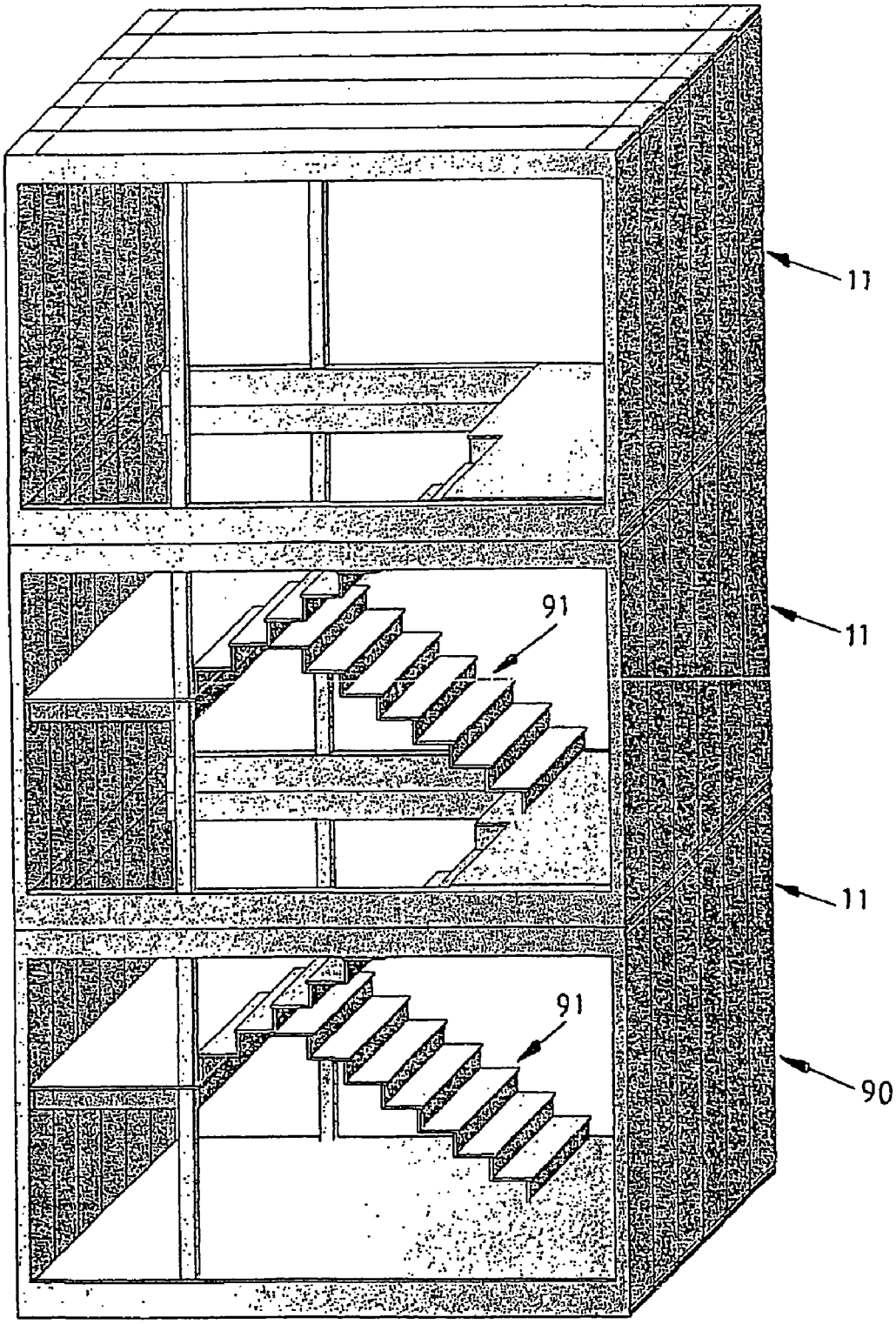
Figure 29:
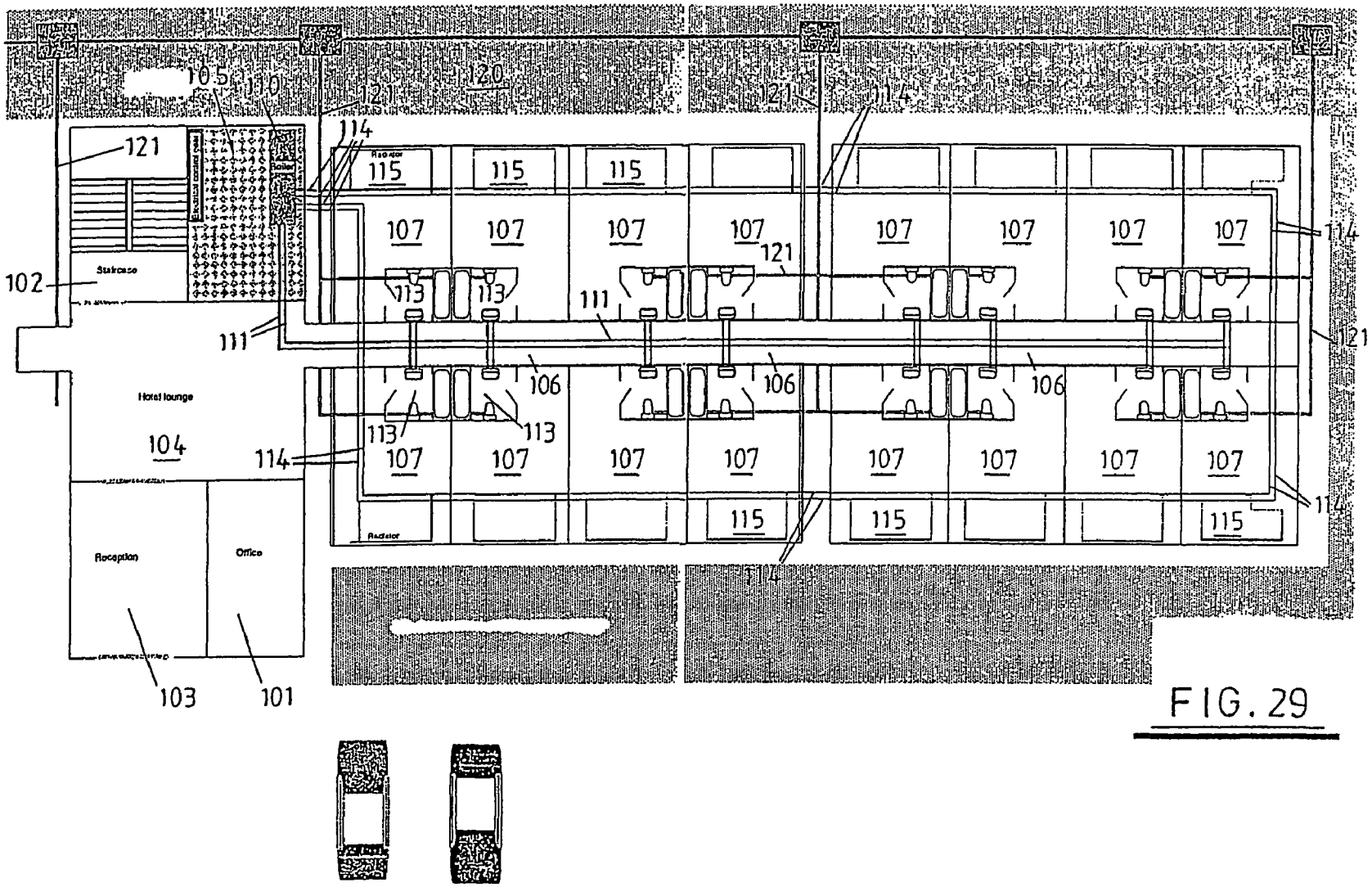

FIGS. 16*a* and 16*b* are part-sectioned views of an upper portion of the post of FIG. 15 showing interchangeable connectors;

FIGS. 17*a* and 17*b* show part-sectioned views of a lower portion of the post of FIG. 15 showing an interchangeable leg and connector;

FIG. 18 is a cross-sectioned plan view of a corner of the building module of FIG. 12, taken below floor level;

FIG. 19 is a cross-sectioned front elevation of the corner shown in FIG. 18;

FIG. 20 is a cross-sectioned plan view of a corner of the building module of FIG. 12, taken at ceiling level;

FIG. 21 is a cross-sectioned front elevation of the corner shown in FIG. 20;

FIGS. 22 and 23 are, respectively, side and end views of the building module of FIG. 3 to 5 and 12, showing filleting channels;

FIG. 24 is a plan view of the module of FIGS. 22 and 23 and shows tops of the lifting frames;

FIGS. 25*a* and 25*b* are sectioned side views of part of two modules of the present invention and illustrate the interconnection between adjacent modules;

FIG. 26 is a sectioned end view of a half fillet used in the interconnection of building modules of the present invention;

FIG. 27 is a sectioned end view of a fillet pad used in the interconnection of vertically stacked building modules of the present invention;

FIG. 28 is a perspective view of a stairwell building module;

FIG. 29 is a plan view of an alternative building structure; and

Figure 30:
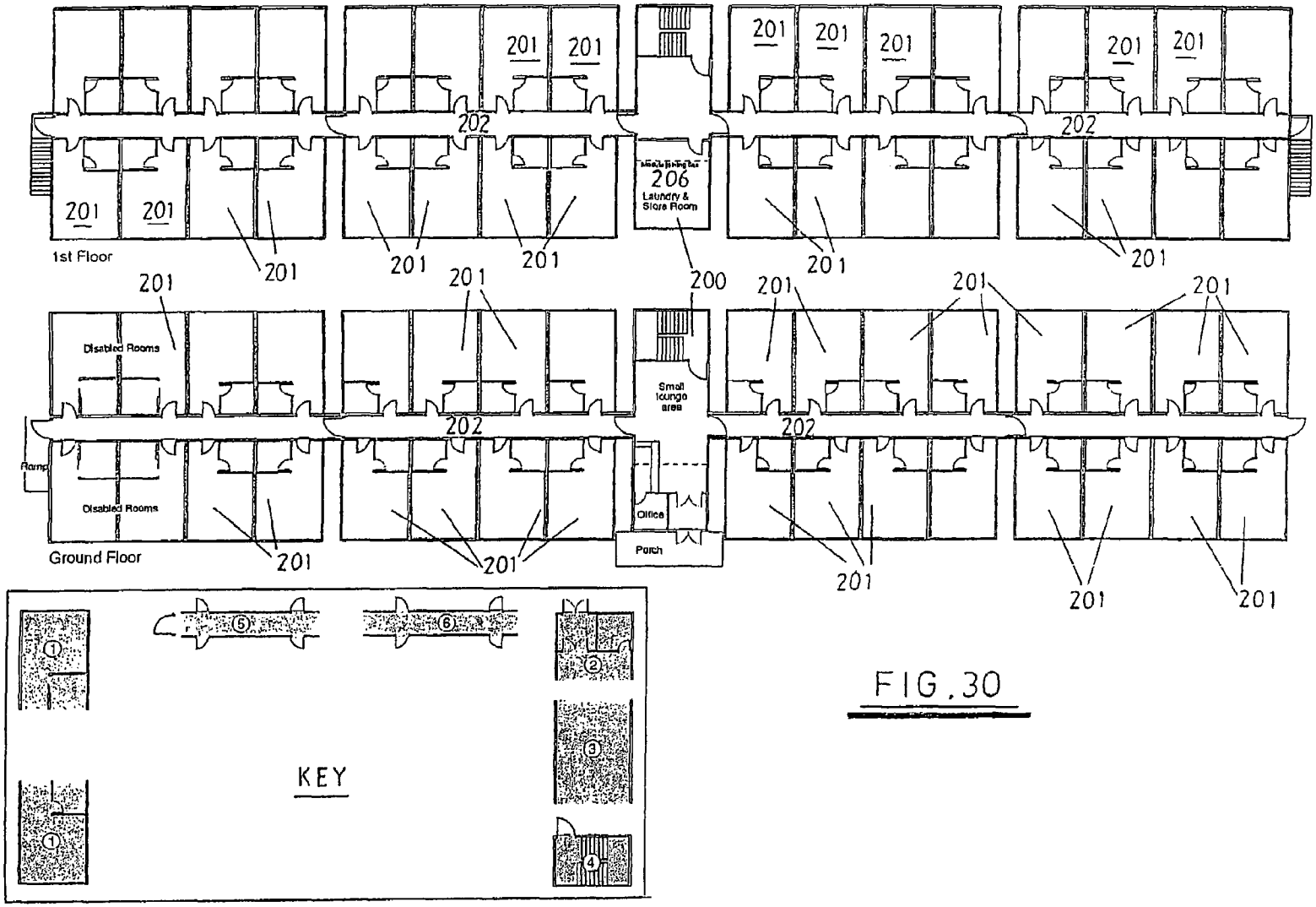

FIG. 30 is a plan view of a further alternative building structure.

Figure 1:
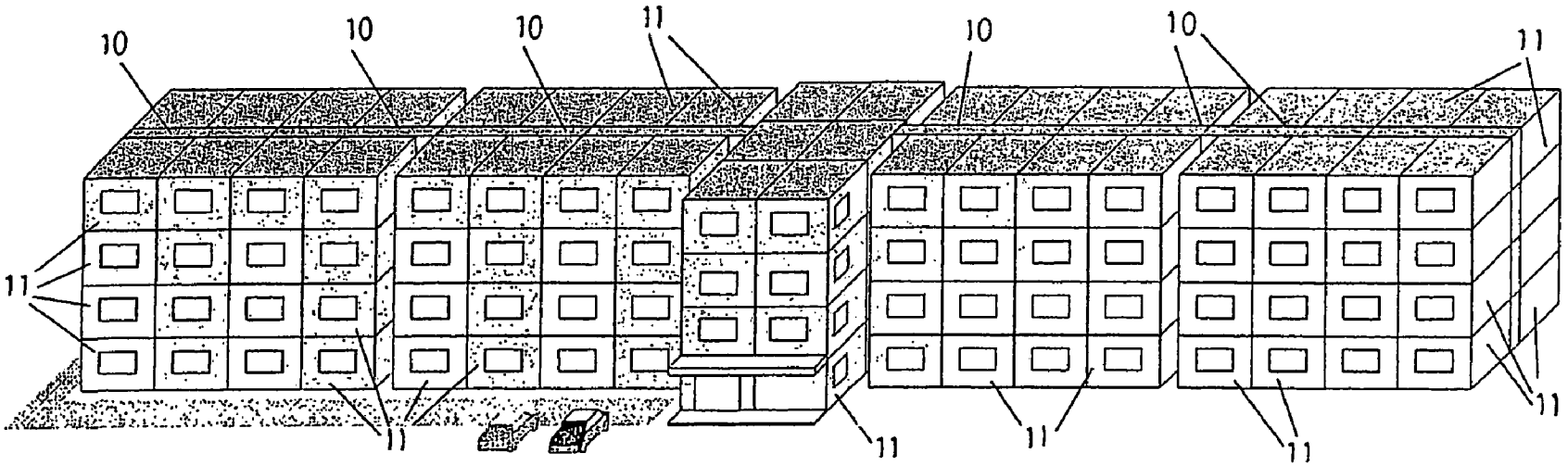
FIG. 1 is a schematic perspective view illustrating a typical modular building structure embodying the present invention.

Referring now to the drawings, an exemplary embodiment of a modular building structure of the present invention is illustrated in FIG. 1. The structure is in the form of a motorway hotel or motel and comprises a plurality of prefabricated, pre-fitted, self-supporting building modules arranged in both vertical and horizontal array. The building modules are divided into a plurality of corridors 10 to each of which are connected a plurality of accommodation modules 11 that form the hotel rooms. The corridors 10 form passageways that, in addition to providing walkways between accommodation modules 11, carry and distribute service supply lines to the accommodation modules 11. The building shown has multiple storeys that are interconnected by stairwells 11 a.

Figure 2:
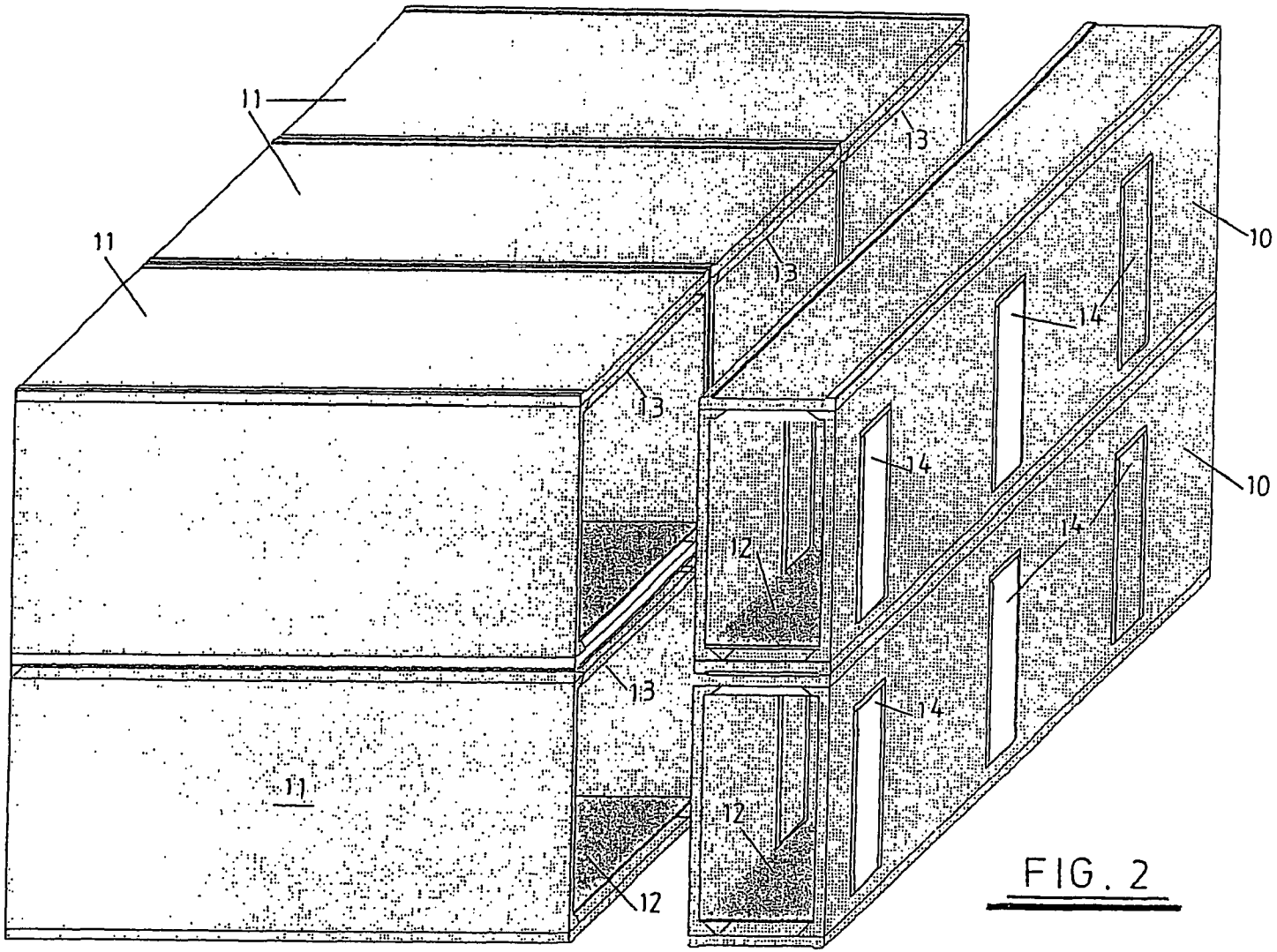
FIG. 2 is a schematic partially exploded perspective view illustrating the interconnection of corridor and accommodation building modules of the present invention.

FIG. 2 shows part of the structure of FIG. 1 and illustrates schematically the connection of a two-storey group of accommodation modules 11 to a pair of corridor modules 10 that are disposed in vertical array. Each accommodation and corridor module is of the same basic construction as will be described below and is in the form of an open-ended box configuration with an internally mounted floor 12 and ceiling 13. The interconnection of the accommodation modules 11 to adjacent accommodation modules 11 and to the adjacent corridor module 10 will be described in detail below. Door openings 14 are provided at spaced intervals on each side wall of the corridor 10 so as to provide access to the adjoined accommodation module 11.

Figure 3:
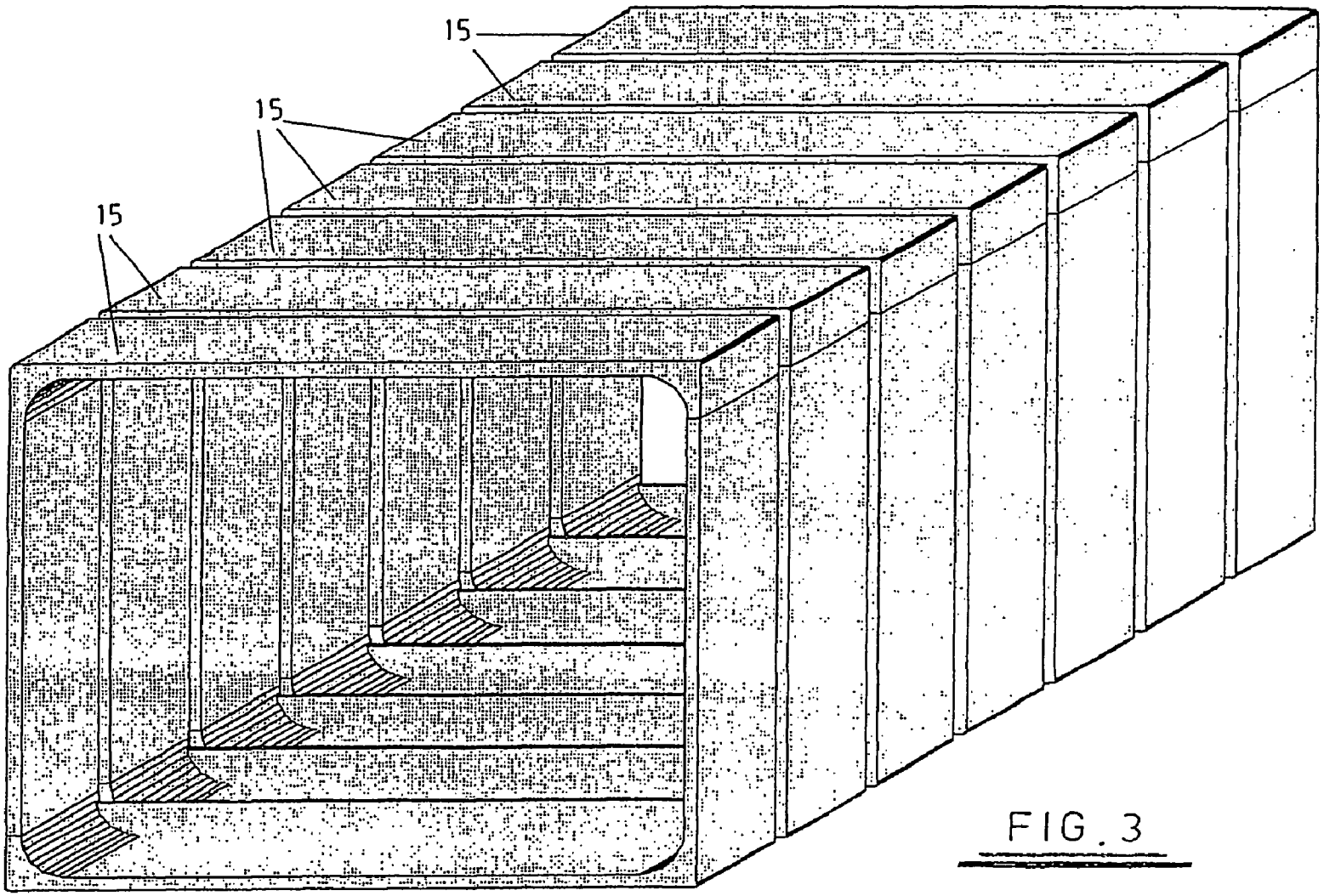
FIG. 3 is a schematic perspective view of a building module of the present invention shown in a slightly exploded configuration.

The building modules 10, 11 are each constructed from a plurality of coaxial segments 15 of open-ended box shape as shown in schematic arrangement in FIG. 3 (the segments are shown slightly separated from one another for clarity). Each segment is in the form of a unitary rectangular frame moulded from a composite material such as water-extended polyester resin with water and a mineral filler that is described in UK patent no. 2306495B. This is a particularly suitable material as it is a natural insulator against heat and has elastic characteristics that allow the module to bend slightly and render it shock absorbent. However, other composite materials such as concrete, cement, ceramic or any appropriate syntactic composite material may be used. The segment frame may be divided into separate interconnected moulded parts if appropriate. The connection of segments to each other is described below.

Figures 4, 5, 6:
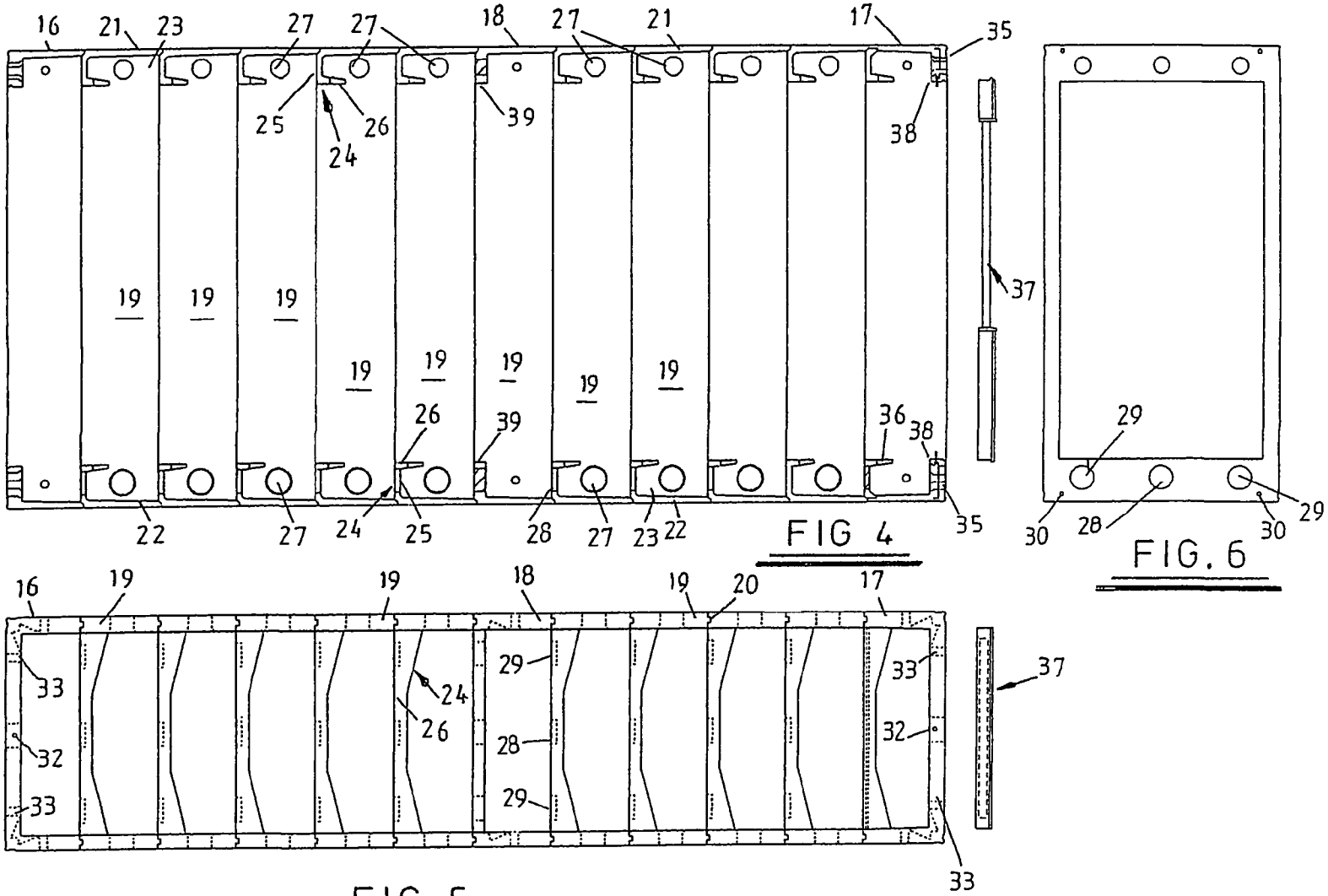
FIG. 4 is a sectioned side elevation of the building module of FIG. 3 shown with an end wall spaced from the rest of the module.
FIG. 5 is a sectioned plan view of the module of FIG. 4.
FIG. 6 is a cross-section through a mid-point of the module of FIGS. 3 and 4.

In the exemplary embodiment shown in FIGS. 4 to 6, each module comprises a front end fascia segment 16, a rear-end fascia segment 17, a mid-support segment 18 and a plurality of intermediate segments 19. The precise arrangement may vary depending on the intended use of the module. For example, the number of intermediate segments 19 may be increased or decreased depending on the length of module required and in shorter modules the mid-support segment 18 may be omitted. The segments 16 to 19 are engaged with one another by means of a tongue and groove connection 20 and are bonded to each other by a suitable adhesive.

Figure 7:
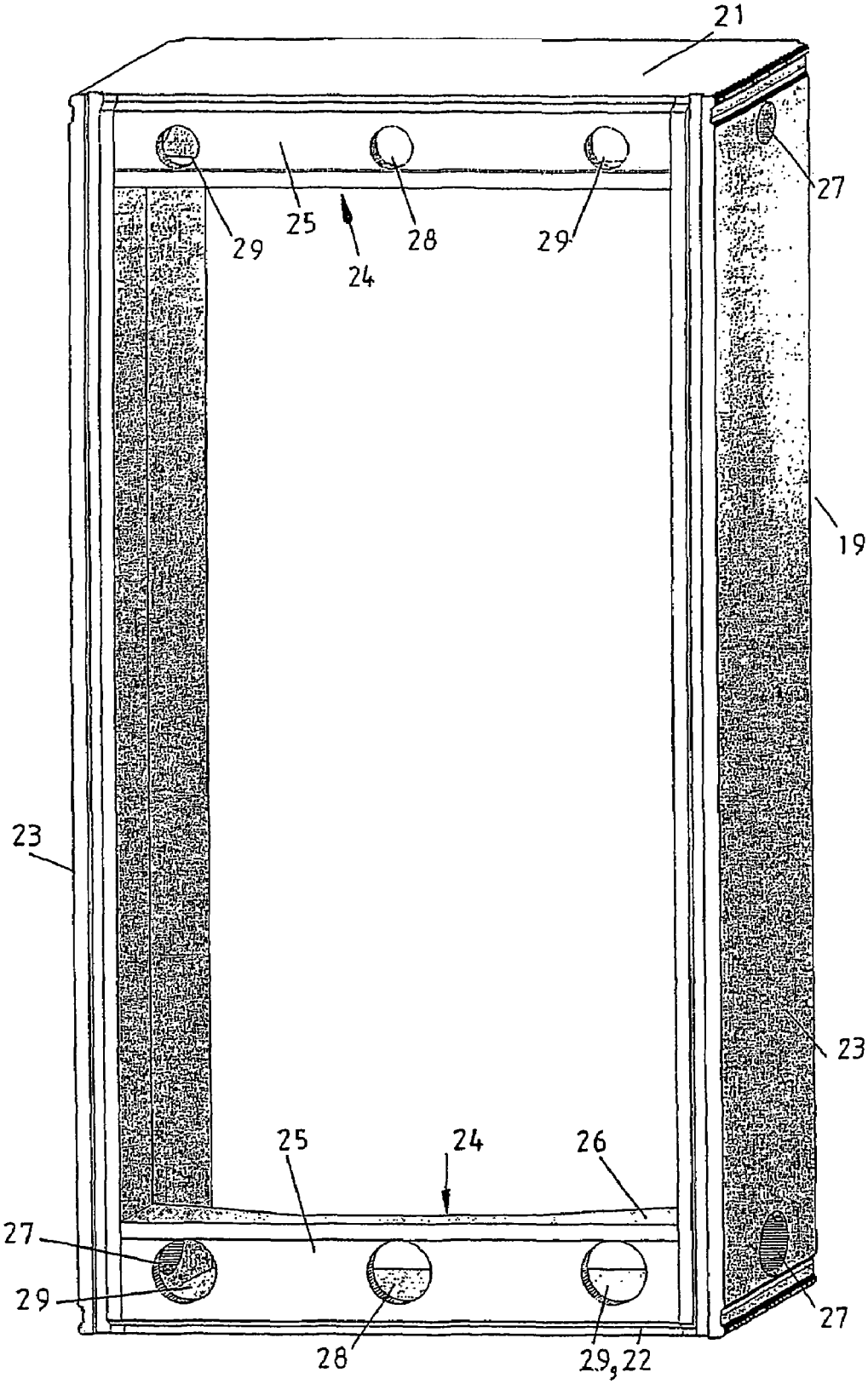
FIG. 7 is a perspective view of the front of an intermediate segment of the module of FIGS. 3 to 5.
Figure 8:
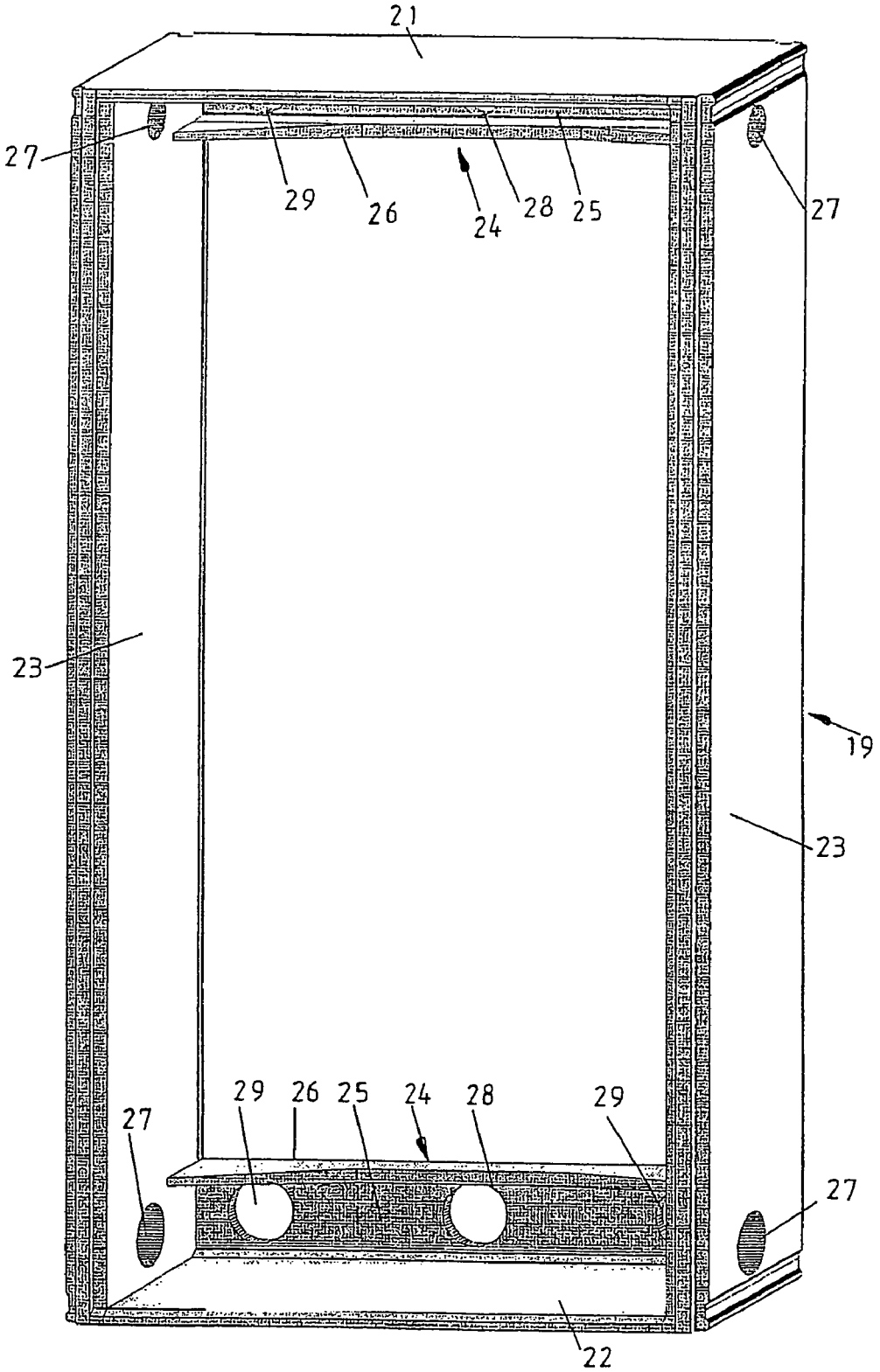
FIG. 8 is a rear perspective view of the intermediate segment of FIG. 7.

Each intermediate segment 19 (shown in detail in FIGS. 7 and 8) comprises upper 21, lower 22 and side walls 23. The upper 21 and lower walls 22 are relatively thin in comparison to the thickness of the side walls 23 and may include reinforcement in the form of a wire mesh (not shown) embedded in the moulded material. At the front end of each segment 19 there are beams 24 integrally connected to the upper 21 and lower walls 22. As well as imparting additional rigidity to the module segments, the beams 24 provide support for the floor 12 and ceiling 13 and each comprise a vertical section 25 and a terminal horizontal section 26 disposed parallel to the upper 21 and lower walls 22. Each of the side walls 23 has ports 27 at its upper and lower ends for receiving service conduits (not shown). The vertical portions 25 of the beams 24 have a central port 28 and two flanking ports at 29 for the same reason. Smaller apertures 30 are provided near the comer of the beam 24 for receipt of a tie bar as will be described below.

The remaining segments are of the same general construction as the intermediate segments. Features that differ from the intermediate segments will be described below.

Figure 9:
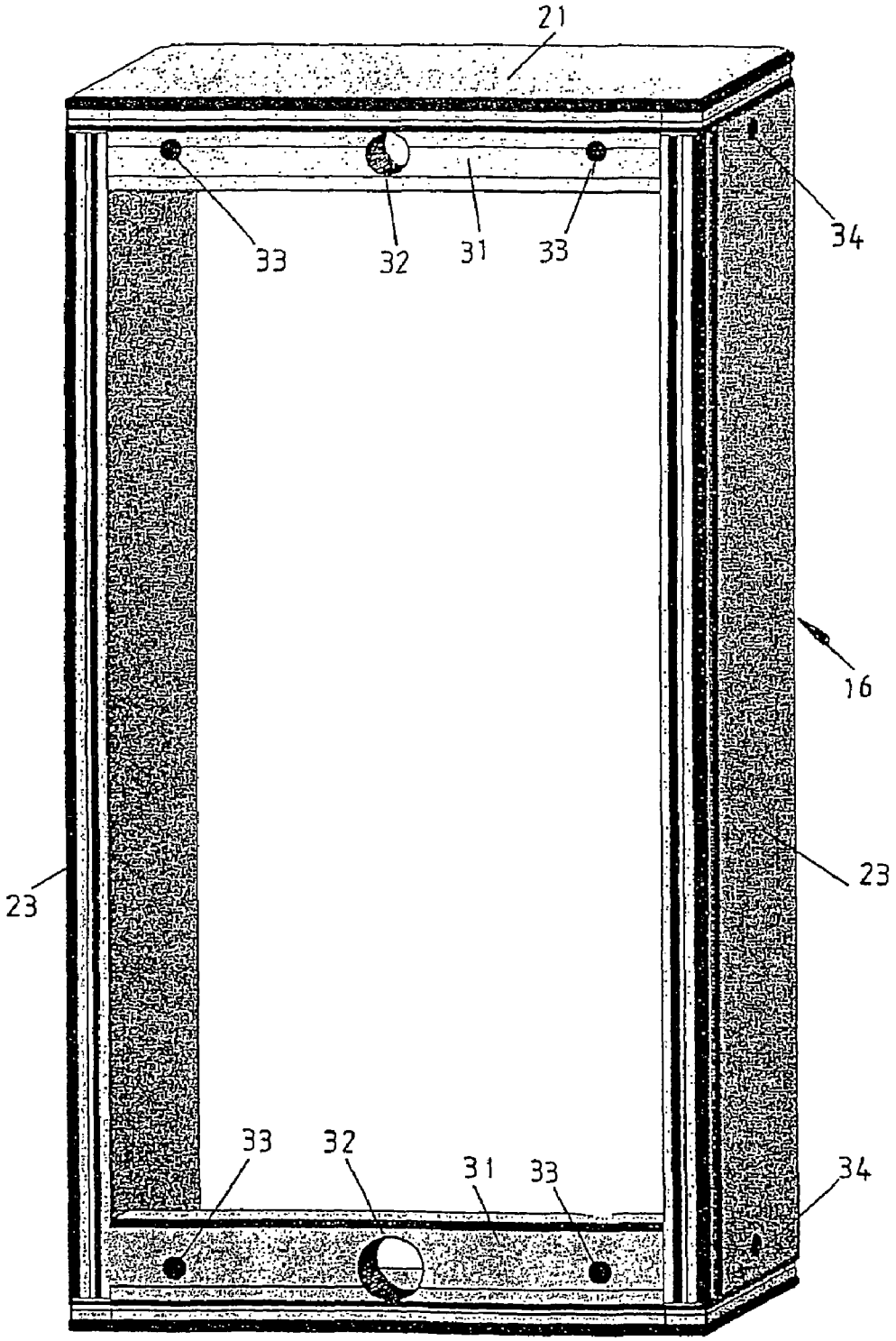
FIG. 9 is a front perspective view of a front end fascia segment of the module of FIGS. 3 to 5.
Figure 10:
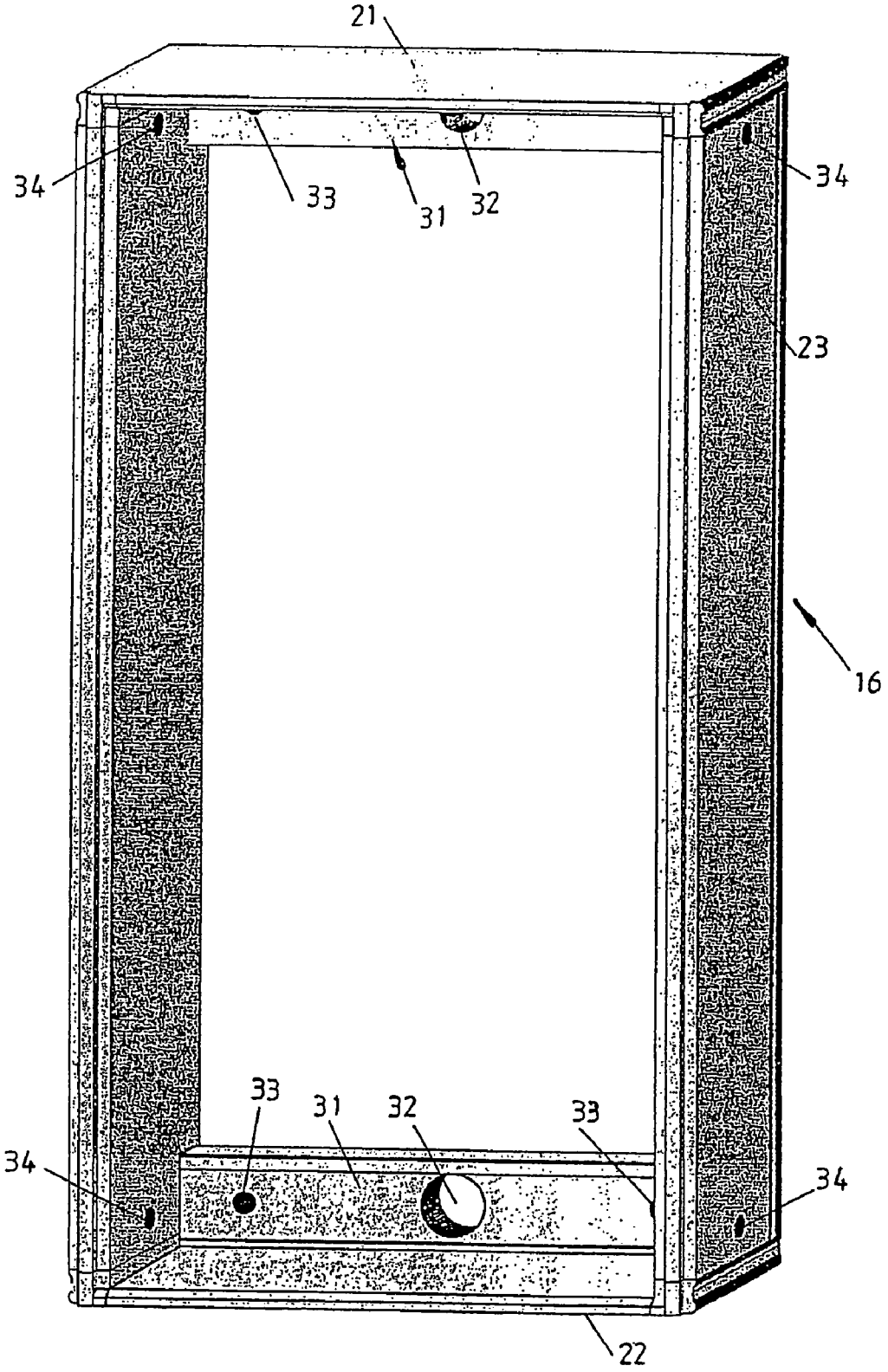
FIG. 10 is a rear perspective view of the front end fascia segment of FIG. 9.

The front end fascia segment 16 (FIGS. 9 and 10) differs from the intermediate segment 19 in that the floor and ceiling support beams 31 extend in the vertical direction only. The beams 31 are integrally connected to the lower and upper walls 22, 21 respectively and each has a large central port 32 flanked by two smaller ports 33 (intended for intermodule fastenings as described below) and two small tie-bar apertures 30 as before. The side walls 23 have two small ports 34, one adjacent to each of the upper and lower walls 21, 22.

The rear end fascia segment 17 (FIGS. 5 and 6) has first upper and lower vertical beams 35 at its rear end that are identical in configuration to that of the front end fascia (including the port configuration) and upper and lower second beams 36 at its rear end that are identical to the corresponding beams 24 on an intermediate segment 19. The segment 17 is fitted with an end wall frame 37 (shown in FIGS. 4 and 5) that partially closes the opening at the rear end of the segment and is fixed to an inwardly facing edge 38 of the first vertical beams 35. The beams 35 for the rear end fascia may be moulded separately and bonded to the walls of the segment.

The mid-support segment 18 is of substantially the same configuration as the front end fascia segment 16 and has only a vertical beam 39 that corresponds to those on the front and rear end fascia segments 16, 17.

The side walls of each of the segments may have internal vertical conduits formed during the moulding process. These are used, typically, to receive electrical cables. The conduits extend from below the floor to above the ceiling.

Moreover, suitable blanks in the modules may be used to form openings in the side walls for doors or windows.

Figure 11:
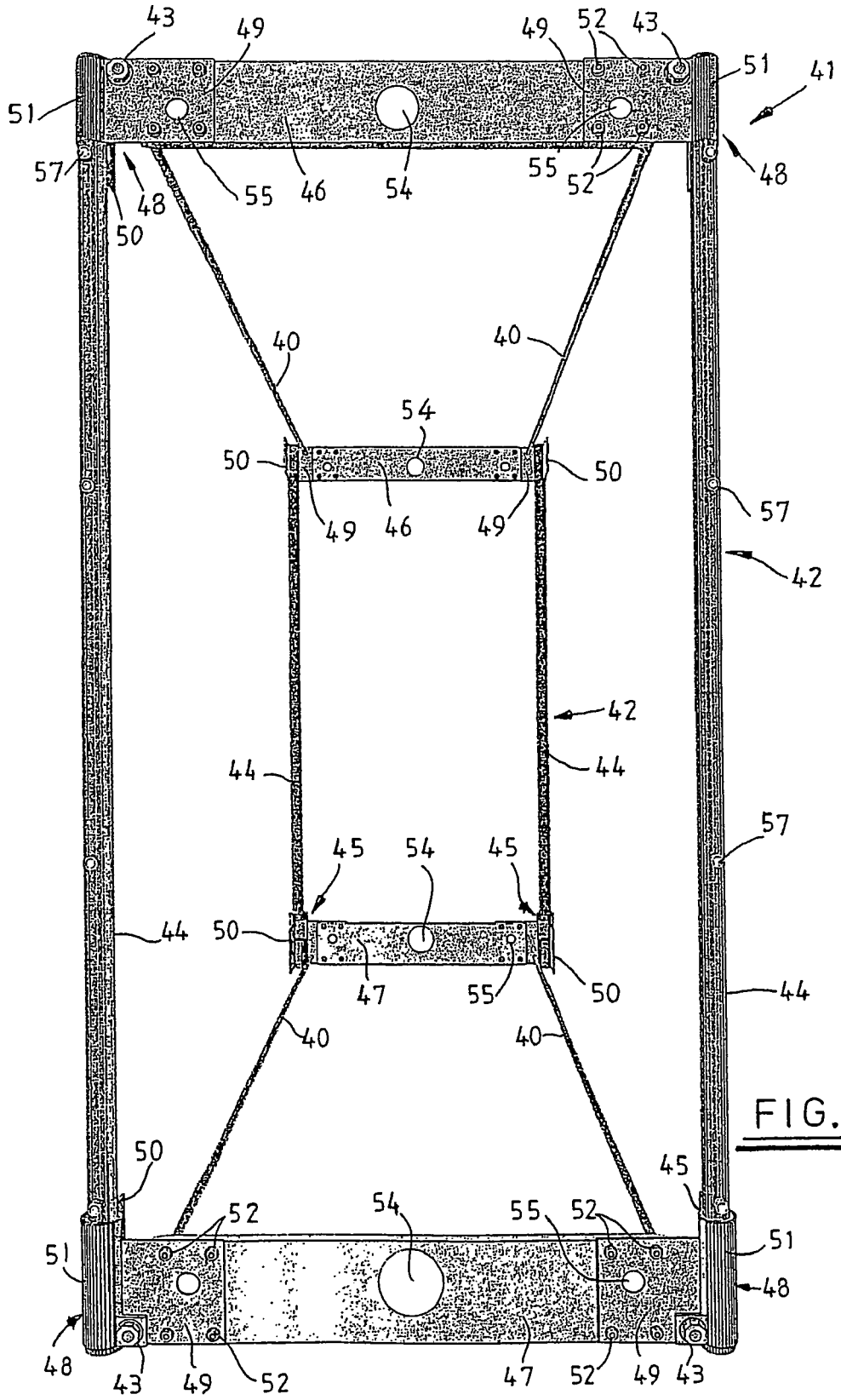
FIG. 11 is a front perspective view of a lifting frame of the building module of the present invention.

The segments 15 of each building module are held together by four parallel longitudinally extending tie bars 40 that pass through the aforementioned corner apertures 30 of each segment 16-19 as shown in FIGS. 4 and 5. The tie bars 40 form part of a box-shaped lifting frame 41 (shown in detail, separate from the building module, in FIG. 11) and are secured at each end to an end frame 42 of the lifting frame 41 by means of a threaded nut 43 in such a way that the segments are clamped together. Each end frame 42 is embedded in the front and rear end fascia segments 16, 17 in the moulding process and comprises two vertical posts 44 that are spaced apart horizontally by the approximate width of the module. The posts 44 are received in sleeves 45 at their lower ends and are connected to each other by upper and lower horizontal bars 46, 47 that are connected at each end to corner members 48 of the end frame 42. Each comer member 48 comprises a substantially right-angled plate having perpendicular first and second connector portions 49, 50 joined integrally by an arcuate portion 51 that receives the post 44 or the sleeve 45. The first connector portion 49 of the corner member 48 extends in parallel to the horizontal bars 46, 47 and is connected thereto by four bolts 52. The second connector portion 50 extends in a direction parallel to the longitudinal axis of the tie bars 40 and has a single aperture 53 (shown in FIG. 12) for register with the port 34 in the side wall 23 of the end fascia segments 16 or 17. Each horizontal bar 46 has a central port 54 that is flanked by two smaller ports 55 that also pass through the first connector portion 49 of the corner member 48.

The front and rear end segments 16, 17 are moulded around the end frame 42 components of the lifting frame as shown in FIGS. 12, 13 and 14. In applications where the module is of such a length that a mid-support segment 18 is required, a further mid-frame 56 of identical configuration to the end frames 42 is provided as shown.

Each of the posts 44 of the end frames 42 have vertically spaced spigots 57 for connection to lifting tackle (not shown in the drawings). The post may also be fitted at vertically spaced intervals with a cladding support member that projects to the outer surface of the moulded segment and has exposed sockets for the receipt of fixings that secure cladding to the module surface.

Referring now to FIGS. 15 and 17*a*, the sleeve 45 comprises a threaded collar 58 in which a threaded end 59 of the post 44 is received and a further portion in the form of a cylindrical housing 60. The collar 58 and the housing 60 are disposed in a vertically spaced relationship in the arcuate portion 51 of the corner member 48 that interconnects the perpendicular connecting portions 49, 50. The housing 60 receives a support leg 61 having a disc-shaped foot 62 and a threaded upstanding stem 63 that is received in an internally threaded leg holder 64 disposed in the space between the collar 58 and housing 60. The leg 61 extends from the bottom of the module and is adjustable in height by virtue of the threaded connection with the leg holder 64.

The upper end of each post 44 is closed by a cap 65 that has a central threaded aperture 66 for receiving fastenings as shown in FIGS. 16*a* and 16*b*. The fastening shown in FIG. 16*a* is an eye bolt 67 that is threadedly engaged in the cap aperture 66 and provides an eye to which lifting tackle may be connected. The eye bolt 67 may be replaced by an inter-module connector 68 such as the half grommet fastening shown in FIG. 16*b*. Such connectors were described in my aforementioned patent application and are used to connect the module to a vertically adjacent module.

At the lower end of the posts 44 the support legs 61 may be replaced by a half grommet fastening 69 has shown in FIG. 17*b*. The threaded end 70 of the fastening 69 extends from the housing 60 and is used to connect the base of the module to appropriate foundation members (not shown).

FIGS. 18 and 19 show, in section, a corner of the front or rear end fascia segment 16, 17 below floor level. The shaded region indicates a cut away area 71 that provides access to the half grommet fastening 69 or the support leg 61. In FIG. 19 there is also shown, in dotted line, below the cut-away area 71, a housing 72 for inter-module connectors that are described later. The lower horizontal bar 47 and tie-bar 40 shown are connected to the first connector portion 49 of the comer member 48 by a slightly different arrangement of bolts as compared to that shown in FIG. 11.

FIGS. 20 and 21 show the end frame 42 connections at ceiling level. Again the inter-module connection housing 72 is shown in dotted line in FIG. 20 and, again, the connection of the upper horizontal bar 46 and the tie-bar 40 to the second connector portion 49 of the corner member 48 is of slightly different configuration to that shown in FIG. 11.

The dotted lines 73 in FIGS. 18 and 20 indicate an elongate channel in and along the edge of the upper and lower walls 21, 22. This channel 73 is shown more clearly in the context of the overall module structure in FIGS. 22 and 23. It extends along all four edges of the side walls 23 and edges of the front and rear end segments as shown and is designed to receive an elongate fillet strip 74 (shown in FIGS. 25*a* and 25*b*) made of a flexible resilient material, typically EPDM. The strip 74 has profiled faces that are complementary to the profile of the channel and the walls on either side of the channel 73. It is bonded in the channel and allows limited relative movement of adjacent modules. Its resilient qualities allows for minor misalignment of adjoining modules both during initial construction and subsequently as a result of settling, subsidence, thermal expansion and contraction as well as the absorption of shock from earth tremors or the like. The strip 74 acts as a heat and sound insulator so as to limit the transference of noise, vibration and heat (such as that created by a fire) between modules. Finally, the strip 74 also acts as a seal so as to prevent surface water penetrating into the small clearance between the modules.

The top ends of the posts 44 of the lifting frame 41 are exposed to the exterior surface of the upper wall 21 of the module as shown in FIG. 24.

The interconnection of adjacent modules 10, 11 is illustrated in FIGS. 25*a* and 25*b*. The fixing between the modules is a grommet fastening 75 of the kind described in my aforementioned patent application. A flexible grommet 76 is received in grommet housings 72 of the side walls 23 of adjacent modules and the walls are secured together by collars 76 that are received in recesses 77 around the openings to the housings 72. The collars 76 (two different types are shown in the figures) are mounted on the end of respective threaded bolts 78 which, in turn, are threadedly engaged in opposed axial apertures 79 in the grommet 76. The bolts 78 allow the interconnection of the modules to be tightened. The fillet strip 74 is received in the channels 73 of adjacent modules and is sandwiched between the modules.

Where an end face of a module is connected to the side wall 23 of another (e.g. a corridor) the grommet housings are received in parts 33 of the beams 31 of the end fascia and two half fillet strips 80 (shown in FIG. 26) are used. The half fillet strip 80 has a flat side 80*a* and a profiled side 80*b* corresponding to the profile of the full fillet strip 80 referred to above. The flat sides 80*a* of two half fillet strips 80 are bonded side wall 23 of one module at positions that will mate with the end wall channel 73 of the other module. The full fillet strips 74 are then placed in the top and bottom channels 73 of either of the modules such that when the two modules are offered into position the fillets 74 provide a seal. The modules are then secured together with upper and lower grommet fastenings 75.

Vertically stacked modules are separated by a fillet pad 81 (shown in FIG. 27) that is bonded to the underside edges of the upper module and provides the same function as the other fillet strips 74, 80.

The same basic structure of an accommodation module can be used to form a stairwell 90 as is shown in FIG. 28. Three vertically stacked modules from the stairwell and the interfacing (upper and/or lower) walls of the modules are removed so as to accommodate the internal stair structure 91.

FIG. 29 shows one embodiment of the layout of a hotel having a structure in accordance with the present invention. The hotel has a main area comprising separate interconnected modules that are respectively internally fitted to form an office 101, a staircase 102, reception 103, a lounge 104 and a service module 105. The lounge 104 is connected to a corridor module 106 to which are attached a plurality of flanking accommodation modules 107.

The service module 105 contains a water boiler 110 for the supply of hot water to each of the accommodation modules 107 via water conduits 111, and electrical switchgear 112. The water conduits 111 pass along the corridor module 106 (under the floor or above the ceiling) and feed into a bathroom unit 113 in each accommodation module 107. The boiler 110 also feeds a central heating system and the associated conduits 114 pass from the boiler 110 laterally out of the side wall ports 27 in the service module 105 and into the adjacent accommodation module 108 through side wall ports 27 under the floor 12. The conduits 114 connect to a radiator 115 in that module and pass through the side wall ports 27, 34 and/or the ports 28, 29, 31, 32, 33 in the beams to radiators 115 in each of the successive modules as shown, before returning to the boiler 110.

Each module is similarly attached to an external waste disposal system 120 with waste conduits 121 passing laterally under the module floor 12 from the bathroom fixtures of each module to connect with the main waste disposal system outside the module.

It will be appreciated that the segmented configuration of the modules allows modules of differing sizes to be constructed. In FIG. 30 there is shown an alternative layout for a motorway hotel or motel. The ground floor and first floor are shown separately and comprise a central structure 200 that is flanked on each side by accommodation modules 201. A corridor 202 provides communication between the central structure 200 and the accommodation modules 201 on each side. This building structure configuration is constructed from six different module arrangements as is shown by the key. There are sixty four modules of the type designated 1 and these are identical to each other save for different interior fittings and different end walls. There are two modules of the type designated 2 that are part of a ground floor reception area 205 and a laundry/store room 206 directly above; two modules of the type designated 3 that complete the central structure 200; two stairway modules designated 4; and sixteen corridor modules, eight of the type designated 5 and eight of the type designated 6.

It is to be appreciated that whilst the aspects of the present invention have been described with reference to exemplary embodiments taking the form of hotel modules, they may apply to other building structures such as, for example, offices, leisure, retail or industrial complexes or other forms of accommodation.

The general open-ended box structure with strengthening beams provides for a very versatile and robust building module.

The open-end box configuration provides the versatility in that it can be connected to another module in many different ways (e.g. end-to-end or end-to-side) and can receive any suitable end wall for the particular application.

The strengthening beams provide rigidity against racking or other deformation of the box structure and may conveniently be used to support a floor and/or ceiling structure.

The segmented configuration of the structure provides for versatility in that a module may be constructed of any desired length. Moreover, such a configuration permits easy manufacture by moulding.

The segments may be produced in a range of different sizes to suit different applications. In addition to differences in depth, the relative lengths, and thickness of the walls or the width of the segments may be varied.

The provision of ports in the side walls and beams at regular intervals enhances the modular and flexible nature of the product. The side wall ports allow services to be provided from any direction. This is in contrast to the arrangement described in my aforementioned patent application in which services were provided along a corridor for supply through an end face of each building module. The present arrangement eliminates the need for a supply corridor module.

It is also to be appreciated that numerous embodiments may be made to the described embodiments without departing from the scope of the present invention as defined in the appended claims. For example, the end frame section of the lifting frame may be provided only one segment where the module is short in length, although end frames are preferably provided at least on each end segment. In an alternative embodiment the lifting frame may be eliminated entirely.

The invention claimed is:

1. A building module having a box structure with top, bottom and opposed side walls, and comprising a plurality of interconnected coaxial discrete module segments which individually comprise a unitary open-ended rigid box structure molded from a composite material, each segment having integrally formed top, bottom and opposed side walls that combine to define a box with an open interior and opposed open ends, the segments being bonded together in an end-to-end relationship such that the side walls of the segments combine to form the side wall of the module, the bottom walls of the segments combine to form the bottom wall of the module, and the open interiors combine to define the open interior of the module, at least one of the segments having an integrally molded strengthening beam spanning its opposed side walls wherein at least one of the segments has an integral frame by which the module may be lifted, the frame comprising a pair of spaced substantially vertical posts interconnected by upper and lower cross-members, the posts being connected to the cross-members by means of corner plate members, the corner plate members comprising first and second connector portions disposed substantially at a right angle to each other, the first and second connector portions being joined by an intermediate arcuate portion in which part of the post is received.

2. A building module according to claim 1, wherein the strengthening beam is connected to one or other of the top or bottom walls.

3. A building module according to claim 2, wherein the strengthening beam is connected to the bottom wall and supports a floor structure.

4. A building module according to claim 2, wherein the strengthening beam is connected to the top wall and that supports a ceiling structure.

5. A building module according to claim 3, wherein the strengthening beam has ports to allow passage of service conduits under the floor structure.

6. A building module according to claim 4, wherein the segments comprise front and rear end segments with intermediate segments, the intermediate segments each having a strengthening beam with a first portion extending in a substantially vertical direction from one of the top or bottom walls towards the other of the top and bottom walls and a second portion extending in a direction substantially parallel to the top and bottom walls, spaced therefrom and for supporting a floor or ceiling structure.

7. A building module according to claim 6, wherein the front end segment has a strengthening beam that extends only in a substantially vertical direction.

8. A building module according to claim 1, wherein said at least one segment is molded around the frame.

9. A building module according to claim 1, wherein at least two of the segments have a lifting frame and the frames are interconnected by a plurality of elongate support members.

10. A building module according to claim 9, wherein the elongate support members are connected to the segments via part of the lifting frames.

11. A building module according to claim 9, wherein at least some of said elongate support members are disposed above a ceiling of the module.

12. A building module according to claim 9, wherein at least some of said elongate support members are disposed below a floor of the module.

13. A building module according to claim 1, wherein end segments of the module have integral lifting frames.

14. A building module according to claim 13, wherein a mid-module segment also has an integral frame.

15. A building module according to claim 1, wherein the posts have adjustable feet for altering the height of the module relative to the ground.

16. A building module according to claim 1, wherein an upper end of the post is fitted with a lifting attachment by which the module may be lifted.

17. A building module according to claim 1, wherein an upper end of the post is fitted with an inter-module connector for interconnecting vertically adjacent modules.

18. A building module according to claim 1, wherein at least one of the side walls of the module has ports that allow passage of service conduits.

19. A building module according to claim 18 wherein the ports are spaced at regular intervals along the length of the module.

20. A building module according to claim 1, wherein side and/or end walls of the module have at least one channel in which is received a resiliently flexible material.

21. A building module according to claim 1, wherein at least one of the segments has a reinforcing mesh material disposed in at least one of its walls.

22. A building module according to claim 1, wherein the segments are bonded together.

23. A building module according to claim 1, wherein the segments are connected to one another by a tongue and groove formation.

24. A building module according to claim 1, wherein at least one of the segments at the end of the module is fitted with an end wall.

25. A building module according to claim 1, wherein at least one side wall of at least one segment has an interior conduit for services.

26. A building structure comprising a plurality of interconnected building modules as defined in claim 1.

27. A building structure according to claim 26, wherein there is provided a resiliently deformable material sandwiched between adjacent walls of at least two modules.

28. A building structure according to claim 27, wherein the walls of at least one module have channels into which a strip of said material is received.

29. A building structure comprising a plurality of interconnected open-ended box structure building modules, each module separately defining top, bottom and side walls, wherein there is provided a resiliently deformable material sandwiched between adjacent walls of at least two modules, the modules being joined together by a fixing arrangement that extends between apertures in each housing, the fixing arrangement comprising a flexible sleeve connector that extends between the adjacent walls and into said apertures, first and second fixing members each comprising a head and a threaded shank, the heads bearing against a respective internal surface of a wall of the module and the shank being threadedly received in the flexible sleeve connector so that the modules are brought together to compress the resiliently deformable material.

* * * * *